US010782084B2

(12) United States Patent
Pop

(10) Patent No.: US 10,782,084 B2
(45) Date of Patent: Sep. 22, 2020

(54) BIPOD FOR PROJECTILE WEAPONS

(71) Applicant: 4xA Technologies Inc., Port Coquitlam (CA)

(72) Inventor: Alexandru Pop, Port Coquitlam (CA)

(73) Assignee: 4xA Technologies Inc., Port Coquitlam (CA)

( * ) Notice: Subject to any disclaimer, the term of this patent is extended or adjusted under 35 U.S.C. 154(b) by 0 days.

(21) Appl. No.: 16/119,848

(22) Filed: Aug. 31, 2018

(65) Prior Publication Data

US 2019/0072355 A1 Mar. 7, 2019

Related U.S. Application Data

(60) Provisional application No. 62/554,457, filed on Sep. 5, 2017.

(51) Int. Cl.
*F41A 23/10* (2006.01)

(52) U.S. Cl.
CPC ..... *F41A 23/10* (2013.01)

(58) Field of Classification Search
CPC ..... F41A 23/10; F41A 23/08
USPC ..... 42/94; 89/37.01, 37.03, 37.04
See application file for complete search history.

(56) References Cited

U.S. PATENT DOCUMENTS 3,445,082 A * 5/1969 Frazer ..... F41A 23/08 248/183.3
4,288,939 A * 9/1981 Beretta ..... F41A 23/08 42/94
4,607,561 A * 8/1986 Frimer ..... F41A 23/08 89/37.04
7,676,977 B1 * 3/2010 Cahill ..... F41G 11/003 42/94
7,841,122 B1 * 11/2010 Hansen ..... F41A 23/08 42/94
8,402,684 B1 3/2013 Beltz
9,151,562 B1 * 10/2015 Pugliese ..... F41A 23/14
9,303,940 B2 * 4/2016 Bonelli ..... F16M 11/38
10,323,897 B1 * 6/2019 Ding ..... F41A 23/06
2007/0094912 A1 5/2007 Bender
2009/0126250 A1 * 5/2009 Keng ..... F41A 23/10 42/94

(Continued)

FOREIGN PATENT DOCUMENTS

DE 3218765 12/1983
GB 1472800 A * 5/1977 ..... F41A 23/08

OTHER PUBLICATIONS

Gary Paul Johnston; "New DSR-1"; published in Guns & Weapons for Law Enforcement, pp. 18-23 and 76; published Sep. 2002.

*Primary Examiner* — John Cooper
(74) *Attorney, Agent, or Firm* — Oyen Wiggs Green & Mutala LLP

(57) ABSTRACT

A bipod for supporting a projectile weapon is provided. The bipod comprises, for example, a bracket attachable to the projectile weapon, a first leg and a second leg pivotally attached to opposing ends of the bracket respectively, and a base attachable to the projectile weapon and pivotally couplable to the bracket at a joint located between the opposing ends of the bracket, the base having a fiction element at a surface of the base, the friction element frictionally engageable with the bracket so as to provide a friction lock between the base and the bipod retaining the projectile weapon in a desired orientation relative to the bipod.

17 Claims, 16 Drawing Sheets

(56) References Cited

U.S. PATENT DOCUMENTS

| | | | | |
|---|---|---|---|---|
| 2010/0218411 | A1* | 9/2010 | Keng | F41A 23/10<br>42/94 |
| 2014/0115940 | A1* | 5/2014 | Bonelli | F16M 11/38<br>42/94 |
| 2018/0202746 | A1* | 7/2018 | Flood, Jr. | F41A 23/10 |

* cited by examiner

BIPOD FOR PROJECTILE WEAPONS

CROSS-REFERENCE TO RELATED APPLICATIONS

This application claims priority from U.S. Application No. 62/554,457 filed 5 Sep. 2017. For purposes of the United States, this application claims the benefit under 35 U.S.C. § 119 of U.S. Application No. 62/554,457 filed 5 Sep. 2017 and entitled BIPOD FOR PROJECTILE WEAPONS which is hereby incorporated herein by reference for all purposes.

FIELD OF THE INVENTION

This disclosure relates to bipods for supporting projectile weapons such as firearms, rifles, airguns, crossbows or the like.

BACKGROUND

In order to achieve precision and accuracy in shooting activities such as hunting, shooting sports, military and law enforcement, etc. it is generally desirable to achieve and maintain stable alignment of a projectile weapon with a target and to minimize forces acting to disturb the alignment. Examples of disturbing forces that may disrupt alignment of a projectile weapon with an intended target include, but are not limited to, gravitational forces, shocks and/or vibrations, recoil, and forces applied by the operator, support structures and/or devices attached to the weapon.

Shocks and/or vibrations can be generated externally as well as inside the weapon during the shot. For weapons like rifles, causes of internally-generated shocks and/or vibrations include, but are not limited to, the movement of the rifle's mechanism, the explosive initiation of the propellant charge by the primer, the pressure waves created by the burning propellant inside the bore, and the friction between the accelerating projectile and the bore. Internally-generated shocks and/or vibrations may disturb alignment directly. Internally-generated shocks and/or vibrations may also disturb alignment by being reflected back to the weapon from a weapon support system attached to the weapon, such as a bipod, or from a support surface in direct or indirect contact with the weapon. Weapons may be affected by externally-generated shocks and/or vibrations for example, when shooting from a vehicle or aircraft. Alignment-disturbing forces may, in some circumstances, be mitigated by a skilled operator, but acquiring such skills requires time and money and even the best operators are susceptible to stress and fatigue.

Bipods are two-legged stands useful for stabilizing projectile weapons by mechanically supporting a portion of the weapon against a support surface. Bipods are typically designed to support part of the weight of a weapon at the weapon's front end, thereby allowing an operator to align the weapon with a target by supporting and moving the weapon from the rear end. Before the execution of a shot, it is generally desirable for the mounted weapon to have some degree of mobility to help an operator to align the weapon with a target, follow the target if it is moving, move from one target to another, and/or regain alignment for subsequent shots if alignment was lost, all in the shortest time possible and with minimal operator intervention. However, this mobility should be temporarily restricted during the execution of a shot to ensure that the weapon is stable and in proper alignment until the projectile leaves the weapon. After the projectile leaves the weapon, it is generally desirable for the weapon to immediately revert back to a state of high mobility relative to the bipod to, for example, allow the weapon to move rearwards under the recoil force (i.e. allowing for "follow through" of the weapon), allow any generated recoil energy to dissipate with minimal alignment disturbance enabling the operator to maintain uninterrupted visual contact with the target during and after the shot, and facilitate rapid re-alignment for a subsequent shot.

Prior art bipods that have a rigid connection between the weapon and the legs of the bipod are stable during the execution of the shot, but offer limited mobility of the weapon relative to the bipod. These bipods may also have a tendency to "jump" under recoil. Hence, an operator may need to reposition the bipod by lifting the bipod or dragging the feet of the bipod across the ground in order to align or realign the weapon.

Prior art bipods that allow relative movement between the weapon and the legs of the bipod provide easy target acquisition/alignment, but may be unstable during the execution of the shot. To improve stability, these types of bipods may employ a manually-operated mechanical lock (e.g. levers, threaded knobs, etc.) to secure the moving parts of the weapon-bipod system together after the weapon is aligned with the target. Such mechanical locks typically cannot be operated using only gross motor skills. To operate the lock, an operator may have to remove either his/her trigger hand or his/her support hand from the weapon, which may, for example, take time, create visible movement, break shooting stance, and lead to loss of precision and/or accuracy. In addition, the weapon becomes rigidly connected to the legs of the bipod after locking the moving parts of the weapon-bipod system together, thereby suffering from similar disadvantages as bipods that have a rigid connection as described above.

Prior art bipods that are built so that a force required to move the weapon relative to the legs of the bipod is adjustably pre-set with a tensioning knob, are essentially a compromise between the two types described above, with the disadvantage that the weapon and the legs are in the same state of relative mobility throughout the operation cycle and cannot transition quickly from a state of high mobility before or after the shot to a state of strong cohesion/rigidity during the shot.

Alignment of the weapon with an intended target is often achieved by aiming through an optical device (e.g. a telescopic sight), whose optical axis is placed above the bore (barrel) axis of the weapon. Accurate alignment (especially important for shots at longer distance) requires that the optical axis of the aiming device and the bore axis of the weapon are both kept in the same vertical plane. Vertical misalignment can be caused, for example, by operator error, uneven terrain, gravitational induced tilting of the weapon, etc. and may cause a discharged projectile to miss its intended target left or right of the aiming point.

Prior art bipods that are attached to the weapon at a point below the weapon's centre of gravity, and which allow relative movement between the legs of the bipod and the weapon, produce a tendency for the weapon to tilt over around the attachment point under the effect of gravity, which may result in vertical misalignment of the optical axis of the aiming device and the axis of the barrel. To achieve stable vertical alignment for a shot, the operator may observe a levelling device installed on the weapon such as a bubble level or similar device, and may adjust the vertical alignment manually by, for example, rotating the weapon relative to the support, adjusting the length of the legs and/or manually locking the bipod in alignment by operating a locking lever, using a pre-tensioning device, etc. This may add time and movement to the process of aligning a weapon with an intended target.

Prior art bipods where the bipod attaches to the weapon at a point above its centre of gravity may be inherently stable and help the weapon to level itself, similar to a pendulum. These designs may provide varying degrees of relative mobility between the legs of the bipod and the weapon. Some of these designs may be heavy and complex, some may have limited degrees of freedom along only one or two axes, and others may feel loose and may lack the possibility of transitioning from a state of high mobility before the execution of a shot to a state of high stability/rigidity (i.e. limited mobility) during the execution of the shot, and back to a state of high mobility after the execution of the shot.

Prior art portable bipods are generally not designed deliberately and systematically with shock and/or vibration isolating and/or damping features. Shot precision and accuracy may be increased when shock and/or vibration-damping supports, such as sand-bags, are used as compared to when shock and/or vibration-damping supports are not used.

Different shooting situations and positions require different bipod leg lengths and configurations. Prior art bipods may address this by having legs with lengths adjustable within a limited range. Such bipods typically cannot be adjusted over the entire range of lengths necessary for the bipod to be universally useable for any shooting position. For example, the legs of such bipods typically cannot be adjusted for an operator to transition from shooting the weapon in a prone position to a sitting and/or a standing position. Changing a shooting position with such bipods may require replacing the entire bipod, or may require using a different support device, such as a shooting stick or tripod, etc., when changing from one shooting position to another.

When a prior art bipod is not in use, the legs of the prior-art bipod may be folded and stored in a position parallel to the bore axis of the weapon, and underneath the fore-end of the weapon. This may interfere with shooting off-hand, shooting from a resting surface (commonly referred to as a "rest") not attached to the weapon (e.g. a sandbag) and may prevent other accessories (e.g. fore grips, flashlights, lasers, slings, etc.) from being attached to the underside of the weapon.

There is a need for bipods that allow an attached weapon to transition quickly from a mobile state before the execution of a shot to a rigid state during the execution of the shot, and back to a mobile state after the execution of the shot. There is also a need for self-levelling bipods that minimize vertical misalignment between the optical axis of an aiming device (e.g. telescopic sight) and the bore axis of an attached weapon; reduction of direct and reflected shocks and/or vibrations between the weapon, the bipod and a support surface; modular attachment devices which allow a bipod to be removably attached to a multitude of weapon accessory interfaces; quick-detach, interchangeable legs of various lengths and configurations; and bipods with legs that store unobtrusively when not in use but are deployable by an operator quickly with only gross motor skills being required. There is also a need for bipods which achieve the foregoing while minimizing required operator movement and/or intervention (i.e. bipods which minimize introduction of disturbances which may misalign a weapon and/or increase a time required to align a weapon).

SUMMARY

This invention has a number of aspects. These aspects may be combined but may also be applied individually or in sub-combinations. These aspects include, without limitation:

- Bipods for supporting projectile weapons.
- Bipods attachable above the center of gravity of projectile weapons in a self-levelling configuration.
- Bipods configured to permit an attached weapon to rapidly transition between a mobile state and a rigid state.
- Bipods which can be locked in a stable shooting position without the operator breaking shooting stance and without the need to operate external levers or similar devices.
- Bipods which feature a friction lock between the bipod legs and the weapon.
- Bipods configured to permit an attached weapon to move in 3 dimensions.
- Bipods configured to permit continuous adjustment of the force required to move the weapon relative to the bipod.
- Bipods configured to allow ambidextrous adjustments.
- Bipods with modular attachment devices allowing a bipod to be removably attached to a multitude of weapon accessory interfaces.
- Bipods configured to permit an attached weapon to rotate around multiple axes.
- Bipods comprising legs deployable at various angles.
- Bipods comprising legs that are quickly detachable.
- Bipods comprising interchangeable legs.
- Bipods comprising legs that can provide support against horizontal support surfaces as well as against other types of support surfaces including but not limited to vertical and angled surfaces.
- Bipods with legs that store unobtrusively when not in use.
- Bipods that are deployable by an operator quickly with only gross motor skills being required.
- Bipods comprising components and materials useful for shock and/or vibration isolation and/or damping which reduce the direct and reflected shock and/or vibration between the weapon, the bipod and the support surface.
- Bipods comprising feet that provide consistent contact and/or grip on varied surfaces and at various angles of leg deployment.

For the purpose of this application, a rigid state for a weapon may refer to, without limitation, a state where the weapon is attached to a bipod and the weapon is not free to move in relation to the bipod. For the purpose of this application, a mobile state for a weapon may refer to, without limitation, a state where the weapon is attached to a bipod but movable in relation to the bipod.

One example aspect of the invention provides bipods that permit an attached weapon to rapidly transition between a mobile state and a rigid state. Such bipods may comprise locking mechanisms that allow an operator to achieve a rigid state by applying, for example, forward pressure on the weapon against the bipod, also known by a person skilled in the art as "loading" the bipod. In some embodiments, the locking mechanism may be implemented through friction elements such as rubber bumpers that allow two parts of the bipod (e.g., a first component rigidly attached to the weapon, and a second component rigidly attached to the bipod) to frictionally engage each other in any relative position chosen by the operator. In these implementations, the weapon is locked relative to the bipod when the two parts of the bipod are frictionally engaged, but can move freely relative to the bipod when forward pressure is released and the two parts of the bipod are frictionally disengaged.

Another example aspect provides bipods attachable to a projectile weapon at a point above the projectile weapon's center of gravity. Advantageously, this can allow the weapon to level itself by hanging below the attachment point and reduces the likelihood of the weapon being in vertical misalignment due to gravity, uneven terrain, operator error, etc.

Another example aspect provides a bipod comprising a joint that allows an attached weapon to hang freely and pivot around the joint in multiple degrees of freedom. Depending on its design, the joint may provide various degrees of pan, roll and tilt. In some embodiments the joint comprises a tightening mechanism. In such embodiments, an operator can adjust the tightness of the tightening mechanism to control the mobility of an attached weapon along a spectrum ranging from a completely mobile state to a completely rigid state according to, for example, the operator's preference(s) or for storage purposes when the bipod is not in use. The bipod may further comprise ambidextrous controls for adjusting the tightness of the tightening mechanism. In some embodiments, the joint comprises a spherical joint.

A further example aspect provides bipods comprising legs that are rapidly deployable from a rest position to one or more positions suitable for firing an attached weapon (e.g. each position may, for example, be referred to as a "firing position"). In some embodiments, a firing position refers to an upright position where the legs of the bipod are oriented in a direction generally perpendicular to an attached weapon's bore axis, while a rest position refers to a position where the legs of the bipod are folded and secured in a direction generally parallel to an attached weapon's bore axis. Some embodiments provide bipods comprising legs that can be deployed and locked in position at various angles. The angle between the legs of the bipod and an attached weapon's bore axis may be indexed in several positions depending on shooting conditions and/or the operator's preference.

Some embodiments provide bipods comprising detachable legs thereby allowing an operator to switch between legs of various lengths to match a distance between the weapon and a support surface. Such distance may depend on terrain and/or factors, such as, an operator's height, shooting stance and/or shooting position. Some embodiments provide detachable legs that can be quickly removed and/or replaced without tools.

Some embodiments provide bipods comprising legs that fold along the sides of the fore-end of a weapon when not in use. In some embodiments, folding the legs along the sides of the fore-end of the weapon leaves the underside of the fore-end unobstructed.

Some embodiments provide bipods comprising legs that are partially or fully enclosed by elastomeric outer sleeves. The sleeves may advantageously provide improved shock and/or vibration damping, increased operator comfort in adverse environmental conditions (e.g. wet conditions, cold, heat, etc.), and/or better grip when shooting from unusual positions (e.g. with the legs or feet pressed against a vertical or angled support, when shooting downwards with the legs resting on a horizontal rope, shooting downwards from an aircraft, etc.).

Some embodiments provide bipods comprising feet that provide consistent grip on varied surfaces and at various angles of leg deployment. The feet may be made from rubber, polyurethane or other elastomeric materials useful for stabilizing the bipod against different types of support surfaces at various angles and also provide shock and/or vibration isolation and damping between the weapon, bipod, and support surface.

Some embodiments provide bipods comprising shock and/or vibration isolation and/or damping design elements and materials, which reduce alignment disturbances induced by shocks and/or vibrations.

Some embodiments provide bipods comprising modular attachment methods that allow quick attachment and detachment of the bipod to the weapon without tools and/or multiple standardized weapon accessory interfaces.

Further non-limiting exemplary aspects of the invention include:

1. A bipod for supporting an attached projectile weapon, the bipod comprising:
   - a base attachable to the projectile weapon;
   - a bracket shaped to receive the projectile weapon, the bracket comprising first and second opposing ends;
   - the base and bracket coupled at a kinematic joint to form a kinematic pair;
   - a first leg coupled to the first opposing end of the bracket;
   - a second leg coupled to the second opposing end of the bracket; and
   - the bracket frictionally engageable with the base to lock their relative movement as a means to stabilize the orientation of the projectile weapon relative to a target;
   - wherein the frictional engagement between the bracket and the base is disengageable by the weapon's operator or by the weapon's recoil force separating them apart; and
   - wherein the bipod provides a means for the supported projectile weapon to rapidly transition from a state of mobility relative to a target before the execution of a shot, to a state of stability relative to the target during the execution of the shot, and back to a state of mobility after the execution of the shot.
2. A bipod according to aspect 1 wherein one or both of the base and the bracket comprise at least one friction surface, allowing the base and the bracket to frictionally engage each other.
3. A bipod according to aspect 1 wherein the base and the bracket comprise:
   - a first friction surface on the base, the first friction surface frictionally engageable with an opposing friction surface on the bracket by urging them together to provide a first friction lock, the first friction lock retaining the projectile weapon in a first plurality of predetermined orientations relative to the bracket; and
   - a second friction surface on the base, the second friction surface distal from the first friction surface on the base, the second friction element frictionally engageable with a second opposite friction surface on the bracket by urging them together to provide a second friction lock, the second friction lock retaining the projectile weapon in a second plurality of predetermined orientations relative to the bracket, the second plurality of orientations different from the first plurality of orientations;
   - wherein the first and second friction surfaces on the base and on the bracket are located on opposing sides of the joint.
4. A bipod according to aspect 1 wherein the joint between the base and the bracket comprises a spherical joint, and wherein the base and the attached projectile weapon can yaw, pitch and roll around three mutually orthogonal axes passing through the centre of the spherical joint.
5. A bipod according to aspect 4 wherein the spherical joint comprises a means for increasing and decreasing the force required to move the base relative to the bracket.

6. A bipod according to aspect 1 wherein the first and second legs are each pivotally coupled to the first and second opposing ends of the bracket respectively using a coupling mechanism, the coupling mechanism comprising a bracket pin engageable with a leg notch to lock the first and second legs in a leg deployment position relative to the bracket.
7. A bipod according to aspect 6 wherein the coupling mechanism further comprises a plurality of additional bracket pins engageable with the leg notch to lock the first and second legs in a plurality of additional leg deployment positions.
8. A bipod according to aspect 7 wherein the coupling mechanism further comprises a lever biased by a spring, the lever comprising a flared notch for receiving the bracket pin or one of the plurality of additional bracket pins whereby providing a means for the leg to be pivoted and locked in a plurality of leg deployment positions.
9. A bipod according to aspect 8 wherein the coupling mechanism further comprises:
   a concave shaped indentation on the bracket, the indentation shaped to receive a convex portion of the lever when one or both of the first and second legs are folded into a rest position generally parallel to the bore axis of the projectile weapon; and
   a means of pivoting the leg without urging the lever from the said rest position to a first leg deployment position approximately downwards from and perpendicular to the bore axis of the projectile weapon, whereby allowing the projectile weapon operator to deploy the bipod legs using substantially only gross motor skills.
10. A bipod according to aspect 6 wherein each of the first and second legs comprise a leg member removably coupled to a leg cylinder, the leg cylinder pivotally coupled to the bracket.
11. A bipod according to aspect 10 wherein the leg member is removably coupled to the leg cylinder using a bayonet mechanism.
12. A bipod according to aspect 10 wherein the first and second legs are interchangeable with legs different in length from a first length to a second length different from the first length.
13. A bipod according to aspect 1 wherein at least one of the first and second legs comprises a toroidal shaped foot attached to the at least one of the first and second legs with the toroid axis of revolution perpendicular to the axis of the leg, thereby presenting substantially uniform contact surface around the foot's circumference, whereby providing substantially consistent contact between the feet and a support surface in a plurality of leg deployment positions.
14. A bipod according to aspect 13 wherein at least one of the toroidal shaped feet attached to at least one of the first and second legs is constructed similar to a vehicle tire from materials such as rubber, elastomer, or other suitable materials, and the outside surface of the toroidal shaped feet has treads, whereby providing a means for substantially increasing said foot's grip on the support surface.
15. A bipod according to aspect 13 wherein, when the legs are deployed in a position approximately downwards from and perpendicular to the bore axis of the projectile weapon, each of the feet attached to the first and second legs are oriented inwards towards the bore axis of the projectile weapon in a wedge shape, whereby providing a means for substantially increasing the grip of the feet against the support surface.
16. A device for supporting an attached projectile weapon, comprising:
   one or more legs that support all or part of the weight of the attached projectile weapon by transferring said weight to a support surface;
   a means of attaching the legs to the projectile weapon; and
   buffering members sandwiched between at least two contiguous elements of the device, constructed in shapes and from materials suitable to dampen and isolate vibrations, such as polymers, elastomers, foam, etc.;
   whereby providing a means for substantially reducing the effect of direct and reflected vibrations to disturb a predetermined alignment with a target of an attached projectile weapon.
17. A bipod according to aspect 16 wherein at least one of the legs comprises an outer sleeve surrounding at least part of the leg, the outer sleeve made of a material, shape and size suitable for damping vibrations, such as rubber, elastomer, polymer, foam, etc.
18. A method for stabilizing a projectile weapon, the method comprising:
   attaching the projectile weapon to a bipod, the bipod comprising:
      a base attachable to the projectile weapon;
      a bracket shaped to receive the projectile weapon, the bracket comprising first and second opposing ends;
      the base and bracket coupled at a kinematic joint to form a kinematic pair;
      a first leg coupled to the first opposing end of the bracket;
      a second leg coupled to the second opposing end of the bracket; and
      the bracket frictionally engageable with the base to lock their relative movement;
   resting the bipod legs on a support surface;
   frictionally disengaging the base from the bracket by moving the projectile weapon in a predetermined direction, thereby allowing the weapon to yaw, pitch and roll relative to the support surface;
   aligning the projectile weapon with a target; and
   when a predetermined alignment of the projectile weapon with the target has been achieved, frictionally engaging the base with the bracket by moving the projectile weapon in a predetermined direction and thereby locking the relative position between the weapon and the support surface, whereby stabilizing the alignment of the projectile weapon with the target for the execution of the shot.
19. A method according to aspect 18 wherein frictionally disengaging the base from the bracket is achieved by the projectile weapon's recoil force separating them apart, whereby allowing the projectile weapon to move rearwards under the recoil force while reducing the movement of the legs relative to the support surface.
20. A bipod for supporting an attached projectile weapon, the bipod comprising:
   a bracket shaped to receive the projectile weapon, the bracket comprising first and second opposing ends;
      a first leg coupled to the first opposing end of the bracket;
      a second leg coupled to the second opposing end of the bracket; and
      a base attachable to the projectile weapon, the base pivotally coupled to the bracket at a joint located between the first and second opposing ends of the bracket, the base frictionally engageable with the bracket to retain the projectile weapon in a desired orientation relative to the bipod.

21. A bipod according to aspect 20 wherein one or both of the base and the bracket comprise at least one friction element, the friction element increasing a coefficient of friction between the base and the bracket when the base frictionally engages the bracket.

22. A bipod according to aspect 21 wherein the at least one friction element is made of a material for damping one or both of shock and vibration of the bipod.

23. A bipod according to aspect 20 wherein the base comprises:

a first friction element coupled to a first end of a top surface of the base, the first friction element frictionally engageable with a bottom surface of the bracket to provide a first friction lock, the first friction lock retaining the projectile weapon in a first plurality of orientations relative to the bipod; and a second friction element coupled to a second end of the top surface of the base, the second end distal from the first end, the second friction element frictionally engageable with the bottom surface of the bracket to provide a second friction lock, the second friction lock retaining the projectile weapon in a second plurality of orientations relative to the bipod, the second plurality of orientations different from the first plurality of orientations;

wherein the first and second friction elements are coupled to the top surface of the base on opposing sides of the joint.

24. A bipod according to aspect 20 wherein the joint comprises an adjustable tightening mechanism, wherein adjusting the adjustable tightening mechanism adjusts a range of pivotal movement of the joint relative to the bracket.

25. A bipod according to aspect 24 wherein the joint comprises a spherical joint, and wherein the base is pivotally movable around three mutually orthogonal axes passing through the spherical joint.

26. A bipod according to aspect 20 wherein the first and second legs are each pivotally coupled to the first and second opposing ends of the bracket respectively using a coupling mechanism, the coupling mechanism comprising a bracket pin engageable with a leg notch to lock the first and second legs in a first position relative to the bracket.

27. A bipod according to aspect 26 wherein the firing position comprises a position where an angle between a central axis of each of the first and second legs and the projectile weapon's bore axis is 90°.

28. A bipod according to aspect 26 wherein the coupling mechanism further comprises a plurality of additional bracket pins engageable with the leg notch to lock the first and second legs in a plurality of positions different from the first position.

29. A bipod according to aspect 28 wherein the plurality of firing positions comprises positions where an angle between a central axis of each of the first and second legs and the projectile weapon's bore axis is 0°, 30° and 60°.

30. A bipod according to aspect 26 wherein the coupling mechanism further comprises a bushing made of a material for damping one or both of shock and vibration of the bipod.

31. A bipod according to aspect 26 wherein the coupling mechanism further comprises a lever biased by a spring, the lever comprising a flared notch for receiving the pin.

32. A bipod according to aspect 31 wherein the coupling mechanism further comprises an indentation, the indentation shaped to receive the lever when folding one or both of the first and second legs into a rest position.

33. A bipod according to aspect 32 wherein the indentation comprises a concave-shape and the lever comprises a convex portion, the convex portion of the lever receivable by the concave indentation.

34. A bipod according to aspect 33 wherein the flared notch is releasable from the indentation when mechanical force is exerted to rotate one or both of the first and second legs from the rest position to the first position, wherein releasing the flared notch from the indentation requires only gross motor skills of an operator of the projectile weapon.

35. A bipod according to aspect 20 wherein each of the first and second legs comprise a leg member removably coupled to a leg cylinder, the leg cylinder pivotally coupled to the bracket.

36. A bipod according to aspect 35 wherein the leg member is removably coupled to the leg cylinder using a bayonet mechanism.

37. A bipod according to aspect 20 wherein at least one of the first and second legs comprises an outer sleeve, the outer sleeve made of a material for damping one or both of shock and vibration of the bipod.

38. A bipod according to aspect 20 wherein at least one of the first and second legs comprises a foot attached to the at least one of the first and second legs, the foot made of a material for damping one or both of shock and vibration of the bipod and the foot comprising a surface engageable with a supporting surface wherein engagement of the surface with the supporting surface increases a coefficient of friction between the bipod and the supporting surface when the bipod is rested on the supporting surface.

39. A bipod according to aspect 20 wherein each of the first and second legs are pivotally movable inwards towards a bore axis of the projectile weapon.

40. A bipod according to aspect 20 wherein the first and second legs are extendible in length from a first length to a second length different from the first length.

41. A method for stabilizing an attached projectile weapon, the method comprising:

removably attaching the projectile weapon to a bipod, the bipod comprising:

a bracket shaped to receive the projectile weapon, the bracket comprising first and second opposing ends;

a first leg coupled to the first opposing end of the bracket;

a second leg coupled to the second opposing end of the bracket; and a base attachable to the projectile weapon, the base pivotally coupled to the bracket using a joint located between the first and second opposing ends of the bracket, the base frictionally engageable with the bracket to retain the projectile weapon in a desired orientation relative to the bipod;

resting the bipod on a surface; and frictionally engaging the base with the bracket using the weight of the projectile weapon, a force applied to the projectile weapon by an operator of the projectile weapon, or both.

42. A bipod for supporting a projectile weapon, the bipod comprising:

a bracket attachable to the projectile weapon above the projectile weapon's center of gravity;

a first leg cylinder and a second leg cylinder pivotally attached to opposing ends of the bracket respectively;

a first leg member attachable to the first leg cylinder;

a second leg member attachable to the second leg cylinder; and a base to which the projectile weapon may be affixed, the base attachable to the bracket at a joint located between the opposing ends of the bracket, the base having a first friction element at a top surface of the base, the first friction element frictionally engageable with the bracket so as to provide a first friction lock between the affixed projectile weapon and the bipod.

43. A bipod according to aspect 42 wherein the joint comprises a spherical joint and wherein, the base is rotatable around three mutually orthogonal axes passing through the spherical joint.

44. A bipod according to aspect 43 wherein the spherical joint comprises a radial gap on an outer race of the joint, the radial gap having an adjustable width to tighten or loosen the spherical joint relative to the outer race.

45. A bipod according to aspect 42 wherein the first friction element is made of rubber, polyurethane or other elastomeric materials.

46. A bipod according to aspect 42 wherein the first leg cylinder and the bracket are secured to each other by a pin positioned on the bracket and engageable with a notch located on the first leg cylinder so as to lock the first leg cylinder in a firing position.

47. A bipod according to aspect 46 wherein the firing position comprises a position where the angle between the central axis of the first leg member and the attached projectile weapon's bore axis is 90°.

48. A bipod according to aspect 46 wherein the first leg cylinder and the bracket are further secured with one another by a plurality of additional pins so as to lock the first leg cylinder in a plurality of firing positions.

49. A bipod according to aspect 48 wherein the plurality of firing positions comprise positions where the angle between the central axis of the first leg member and the attached projectile weapon's bore axis is 0°, 30° and 60°.

50. A bipod according to aspect 46 wherein the first leg cylinder comprises a lever biased by a spring, the first leg cylinder engages a flared notch of the lever when the flared notch receives the pin.

51. A bipod according to aspect 50 wherein the bracket comprises an indentation, the lever receivable by the indentation to fold the first leg cylinder into a rest position.

52. A bipod according to aspect 51 wherein indentation comprises a concave-shape and the lever comprises a convex portion, the convex portion of the lever is receivable by the concave indentation to fold the first leg cylinder into the rest position.

53. A bipod according to aspect 52 wherein the flared notch is releasable from the indentation when mechanical force is exerted to rotate the first leg cylinder from the rest position to the firing position.

54. A bipod according to aspect 46 wherein the bracket comprises a second pin located at a second end of the bracket, the second leg cylinder engageable with the second pin to lock the second leg cylinder in a firing position.

55. A bipod according to aspect 42 wherein the first leg member is attachable to the first leg cylinder and the second leg member is attachable to the second leg cylinder, the first and second leg members are respectively removably attached to the first and second leg cylinders through a bayonet mechanism.

56. A bipod according to aspect 42 wherein at least one of the first leg member and second leg member comprises an outer sleeve, and wherein the outer sleeve is made of one or more of rubber, polyurethane, and other elastomeric materials.

57. A bipod according to aspect 42 wherein at least one of the first and second leg members comprises a foot attachable to the at least one of the first and second leg members.

58. A bipod according to aspect 57 wherein the foot is made of rubber, polyurethane, or other elastomeric materials.

59. A bipod according to aspect 57 wherein the foot is toroidal-shaped.

60. A bipod according to aspect 57 wherein the foot comprises a plurality of treads around the outer circumference of the foot.

61. A bipod according to aspect 42 wherein the bracket further comprises a shaft protruding outwardly from an end surface of the bracket, and wherein a bushing is engageable with the shaft and a bore within the leg cylinder.

62. A bipod according to aspect 61, wherein the bushing is made of any one or more of a shocks and/or vibrations damping material, shocks and/or vibrations isolating material and self-lubricating material.

63. A bipod according to aspect 42 wherein the bracket comprises a pair of downwardly extending arms positioned at opposing ends of the bracket, each of the arms respectively pivotably engageable with the first and second leg cylinder for allowing the positioning of the first and/or second leg members.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DETAILED DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
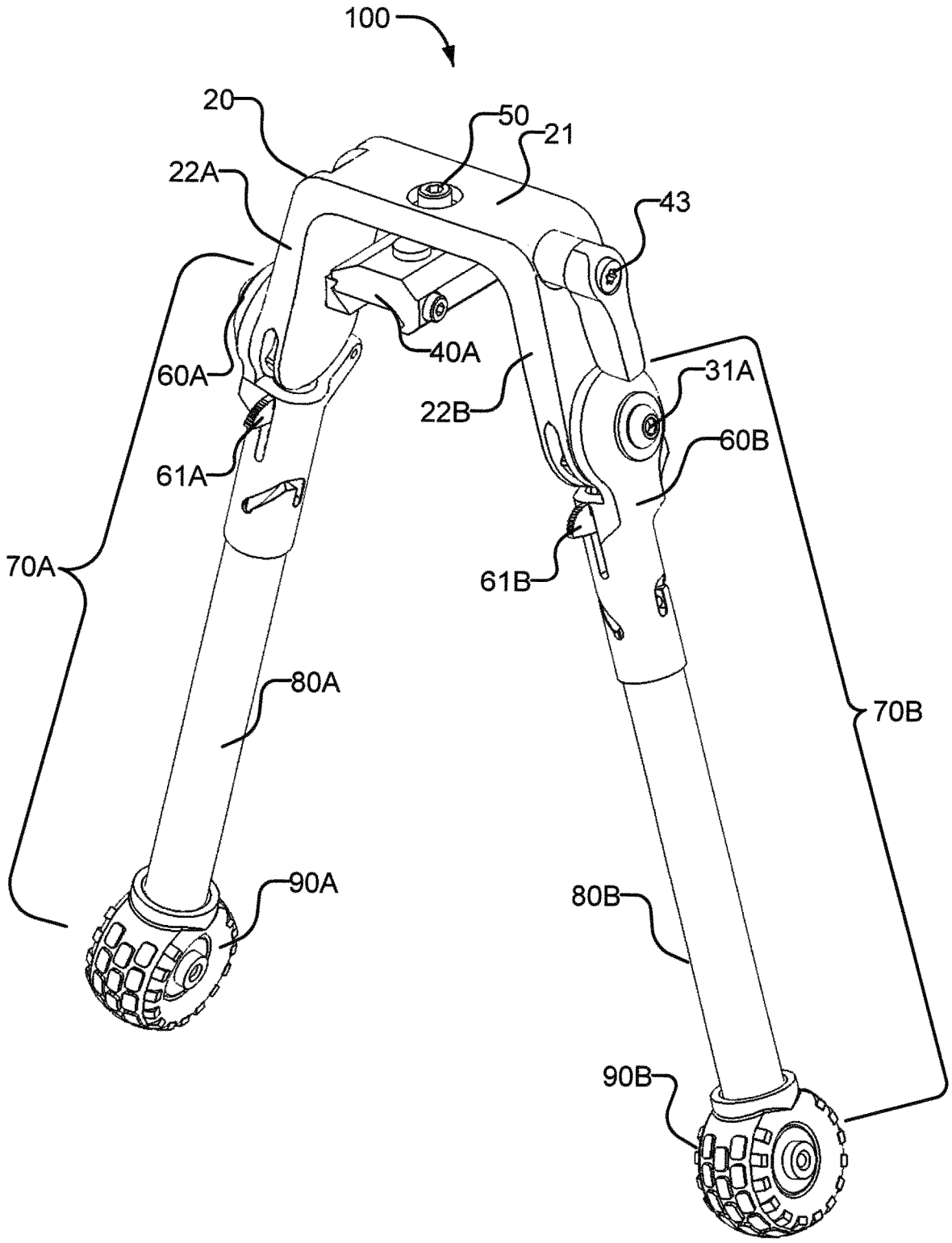
FIG. 1 is a perspective view of an example embodiment of a bipod with its legs deployed in an example firing position.
Figure 2:
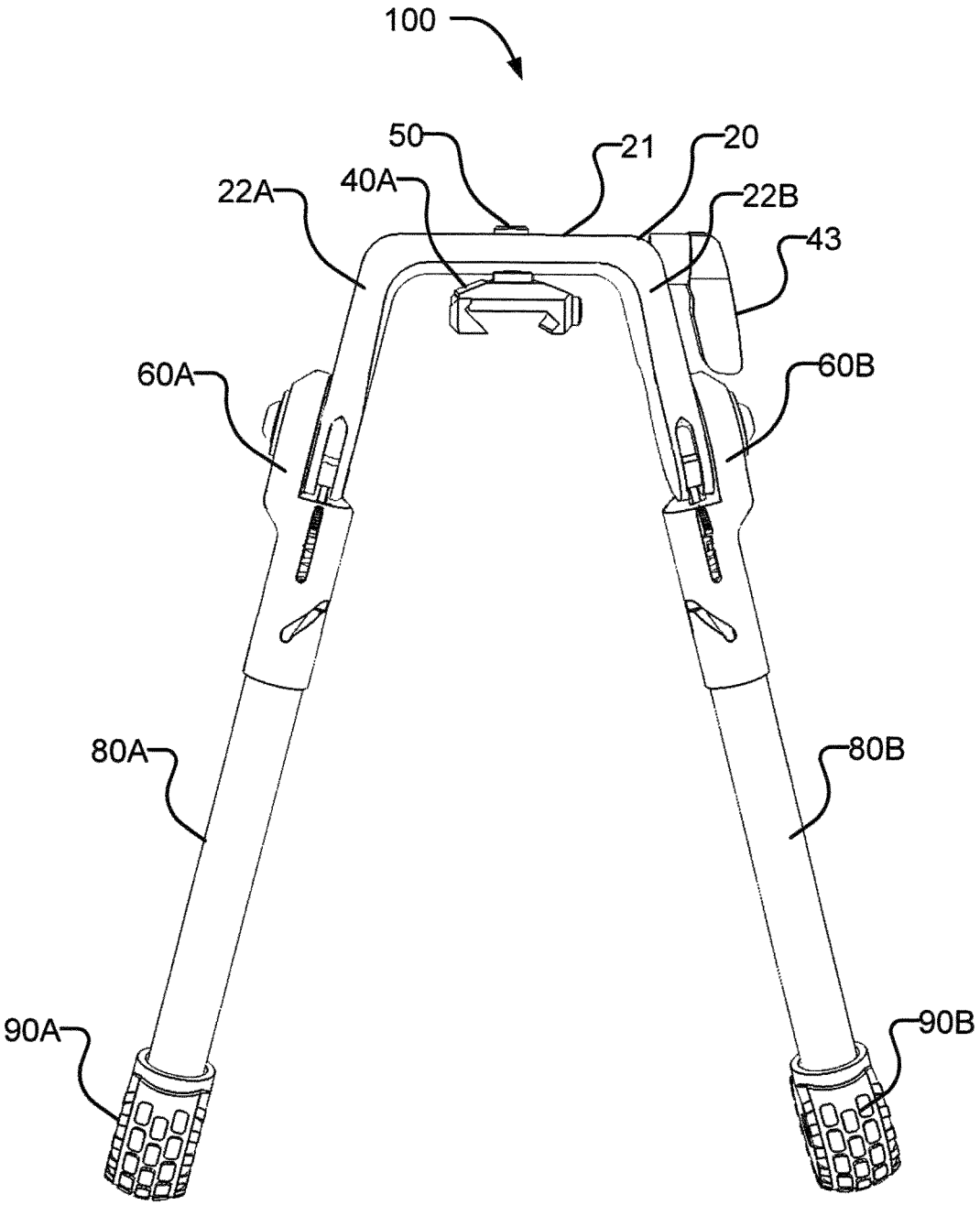
FIG. 2 is a rear view of the bipod according to the FIG. 1 embodiment.
Figure 2A:
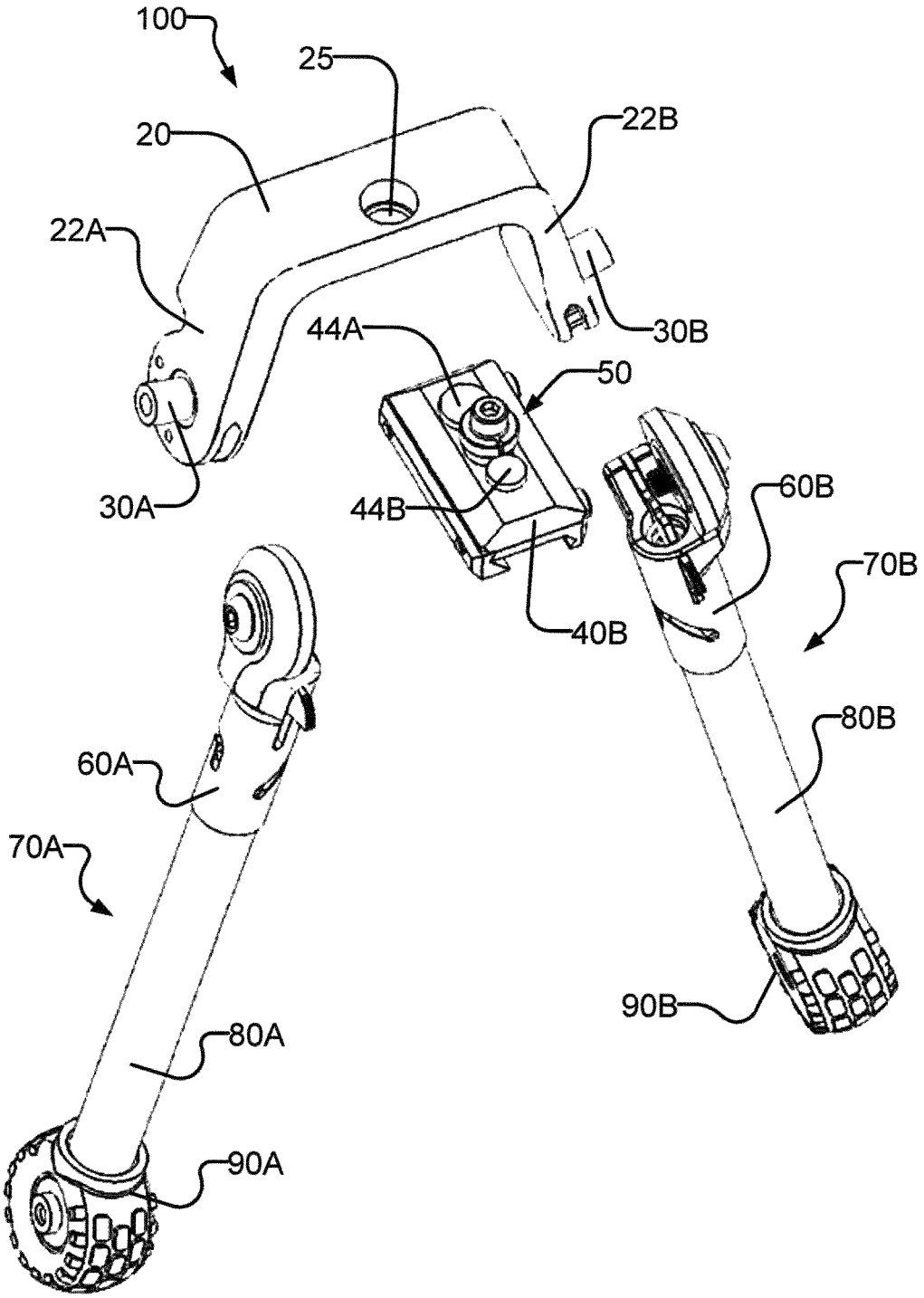
FIG. 2A is an expanded perspective view of an example bipod.

FIG. 1 is a perspective view of bipod 100 according to an example embodiment. Bipod 100 comprises bracket 20, base 40A and legs 70A, 70B (collectively legs 70). Bracket 20 may be generally reverse U-shaped to provide a generally flat platform 21 sandwiched between two arms 22A, 22B (collectively arms 22) that extend in generally downward directions and are angled away from platform 21 (as shown in FIGS. 1 and 2). In some embodiments, platform 21 forms a base of a trapezoid and arms 22 form the sides of the trapezoid. In some embodiments, arms 22 are not angled away from platform 21 (i.e. arms 22 are perpendicular to platform 21). Platform 21 provides a solid surface for mechanically coupling base 40A to bipod 100. Legs 70 may, for example, be pivotally coupled to arms 22 of bracket 20. In some embodiments, legs 70 are rigidly coupled to arms 22. Bracket 20 may, for example, be made from any suitable material including but not limited to various metals, reinforced polymers or the like. In some embodiments, bracket 20 and/or legs 70 are made of one or more composite materials.

Figure 1A:
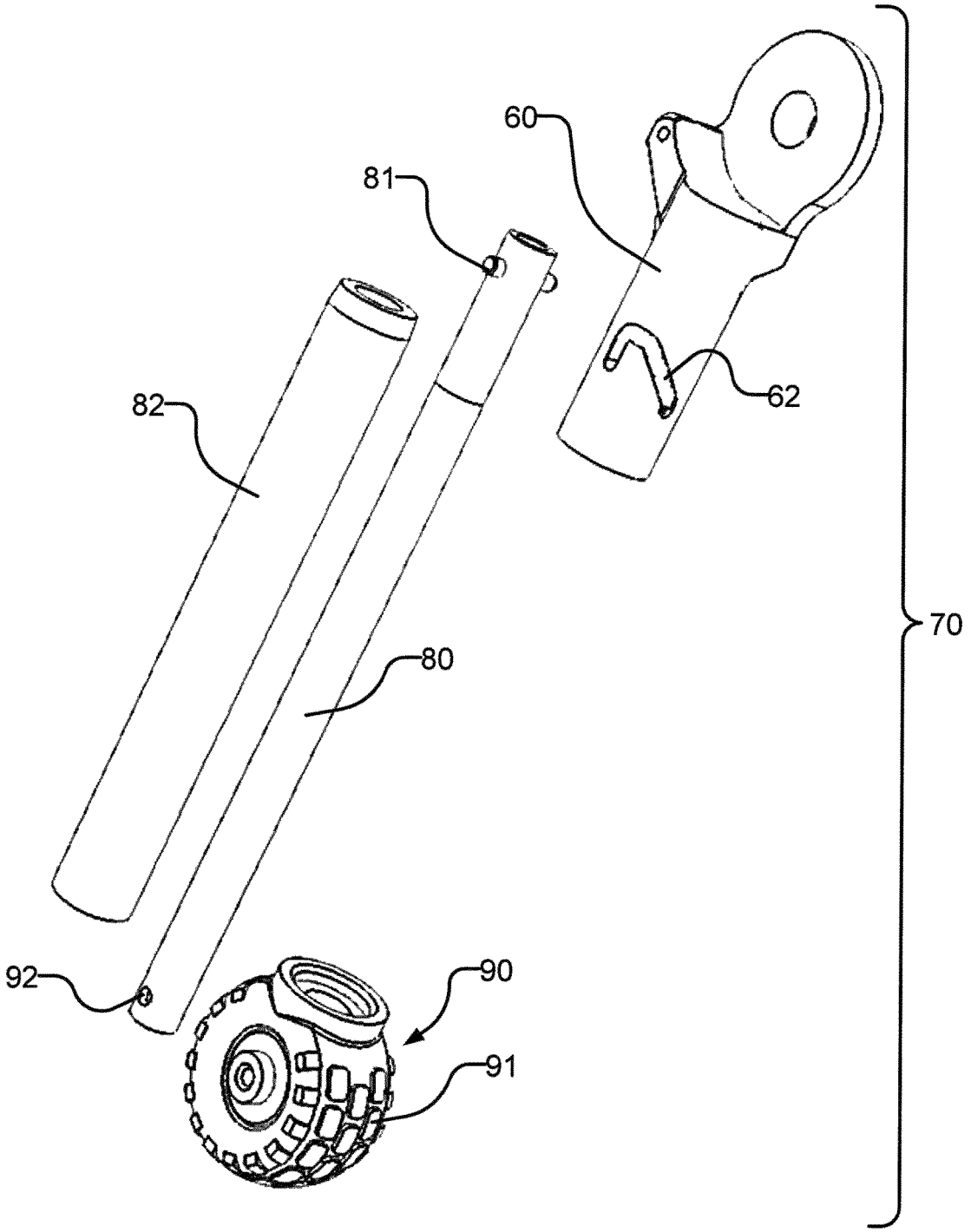
FIG. 1A is an expanded perspective view of an example embodiment of a leg.

In some embodiments, see e.g. FIGS. 1 and 1A, one or both of legs 70 each comprises a leg cylinder 60 (i.e. leg cylinder 60A or 60B), a leg member 80 (i.e. leg member 80A or 80B) and a foot 90 (i.e. foot 90A or 90B). In such embodiments, a leg cylinder 60 pivotally couples a leg member 80 to an arm 22. Leg members 80 may, for example, be made from tubes of metal, reinforced polymer or other suitable material to provide structural rigidity.

Optionally, a leg 70 may comprise an outer sleeve 82 (i.e. outer sleeve 82A or 82B). Outer sleeve 82 dampens shock and/or vibration experienced by bipod 100 and may be equivalent to the elastomeric outer sleeves described elsewhere herein. Outer sleeves 82 (i.e. outer sleeves 82A and/or 82B) may, for example, be made of rubber, polyurethane or other materials suitable for damping of shocks and/or vibrations travelling along legs 70.

Figure 13:
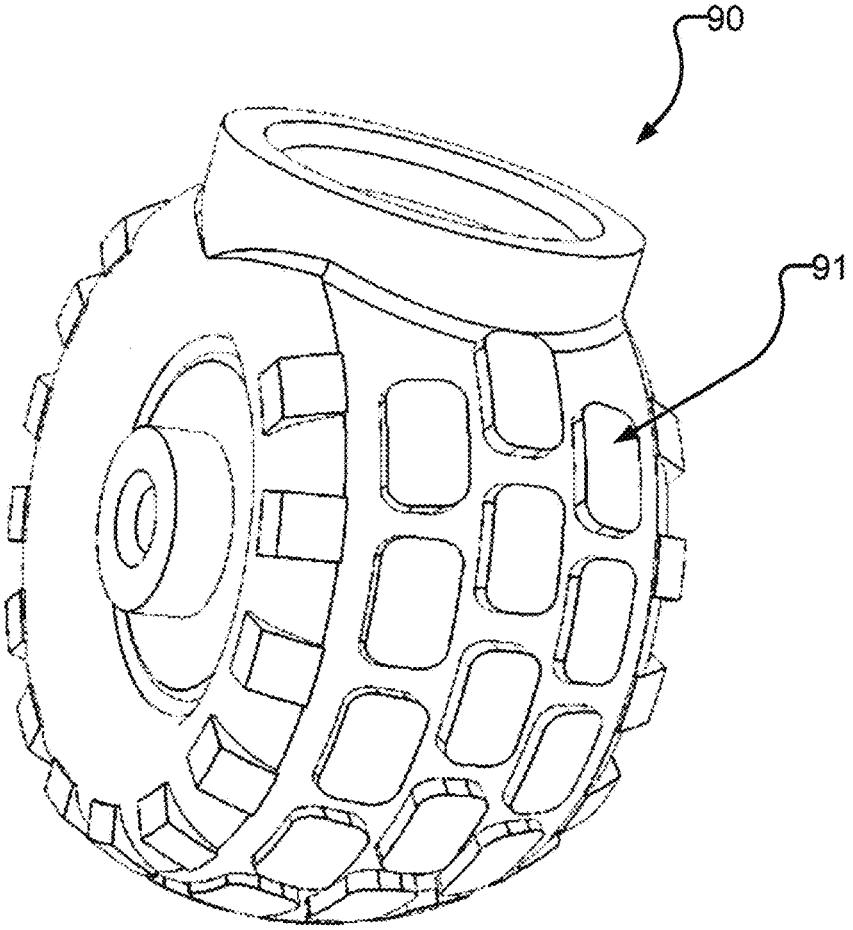
FIG. 13 is a perspective view of an example foot.

Feet 90 may, for example, be made from materials including, but not limited to, rubber, polyurethane, other suitable elastomeric material, etc. Feet 90 may be made from material with good abrasion and/or UV resistance. In some embodiments, feet 90 may have an approximately toroidal shape similar to the shape of vehicle tires (as shown in FIG. 13, for example). The toroidal shape may help feet 90 maintain consistent contact with a support surface, regardless of the position and/or angle of legs 70 relative to a mounted weapon's bore axis. A generally round profile may also allow feet 90 to rotate on a support surface instead of jumping under recoil. In some embodiments, feet 90 may comprise treads 91 (see FIG. 13, for example) around their circumference to improve grip on different surfaces. The construction and materials of feet 90 may also provide damping and isolation of direct and reflected shocks and/or vibrations traveling between the weapon through the bipod to and from a support surface. Foot 90A and foot 90B may be identical, similar or different from each other.

Feet 90A, 90B may, for example, be connected to leg members 80A, 80B with pinned connections where leg members 80 pass through a socket in feet 90 and are attached to feet 90 by inserting pins (not shown) through the centre of feet 90 and holes 92 in leg members 80. In some embodiments, feet 90 are permanently attached to leg members 80. In other embodiments, feet 90 are detachable from leg members 80. Feet 90A, 90B may, for example, comprise treads 91A, 91B respectively (collectively tread 91).

As illustrated in FIG. 1A, a leg 70 may comprise a pin 81 engageable with a leg cylinder 60 through, for example, a bayonet mechanism. Such mechanism allows for a leg member 80 to be easily and quickly detached and/or reattached to a leg cylinder 60. This mechanism also allows for a leg 80 to be easily and quickly exchanged for a leg 80 having a different length and/or configuration. In some embodiments, the bayonet mechanism described herein may comprise a spring 65 (see FIG. 6) within leg cylinder 60. Compression of spring 65 by a coupled leg member 80, for example, exerts a spring force against leg member 80 engaging pin 81 with guide channel 62 of leg cylinder 60. Engagement of pin 81 with guide channel 62 may, for example, prevent inadvertent uncoupling of a leg member 80 from its corresponding leg cylinder 60.

FIG. 2 is a rear view of bipod 100. Leg 70A may be identical to, or different from, leg 70B. In some embodiments, arm 22A, leg cylinder 60A, leg member 80A and foot 90A are identical counterparts of arm 22B, leg cylinder 60B, leg member 80B and foot 90B respectively. In some embodiments, at least one of arm 22A and arm 22B, leg cylinder 60A and leg cylinder 60B, leg member 80A and leg member 80B, or foot 90A and foot 90B is different from its corresponding part forming the collective. For example, leg cylinder 60A and leg cylinder 60B may be mirror counterparts of each other while leg member 80A and foot 90A may be identical to leg member 80B and foot 90B.

In some embodiments, one or more parts corresponding to legs 70A and 70B are interchangeable. For example, leg cylinders 60A and 60B may be interchangeable (e.g. leg cylinder 60B may be coupled to arm 22A and leg cylinder 60A may be coupled to arm 22B). Alternatively, or in addition, leg members 80A and 80B may be interchangeable (e.g. leg member 80B may be coupled to leg cylinder 60A and leg member 80A may be coupled to leg cylinder 60B). As a further alternative, or further addition, feet 90A and 90B may be interchangeable (e.g. foot 90B may be coupled to leg member 80A and foot 90A may be coupled to leg member 90B).

Base 40A is mechanically couplable to bracket 20 at platform 21 through mounting joint 50. A projectile weapon (not shown) can be attached to base 40A, thereby mounting the projectile weapon to bipod 100. In some embodiments, the projectile weapon (e.g., a rifle) may comprise various types of proprietary modular mounting interface devices (e.g., Picatinny rails, M-LOK® rail, Keymod™ rail, etc.)

and base 40A may be removably attached to various clamping or other attachment devices (not shown) to allow base 40A to attach to different types of mounting interfaces that may be present on a weapon. In some embodiments, base 40A is rigidly attached to the projectile weapon.

Figure 2B:
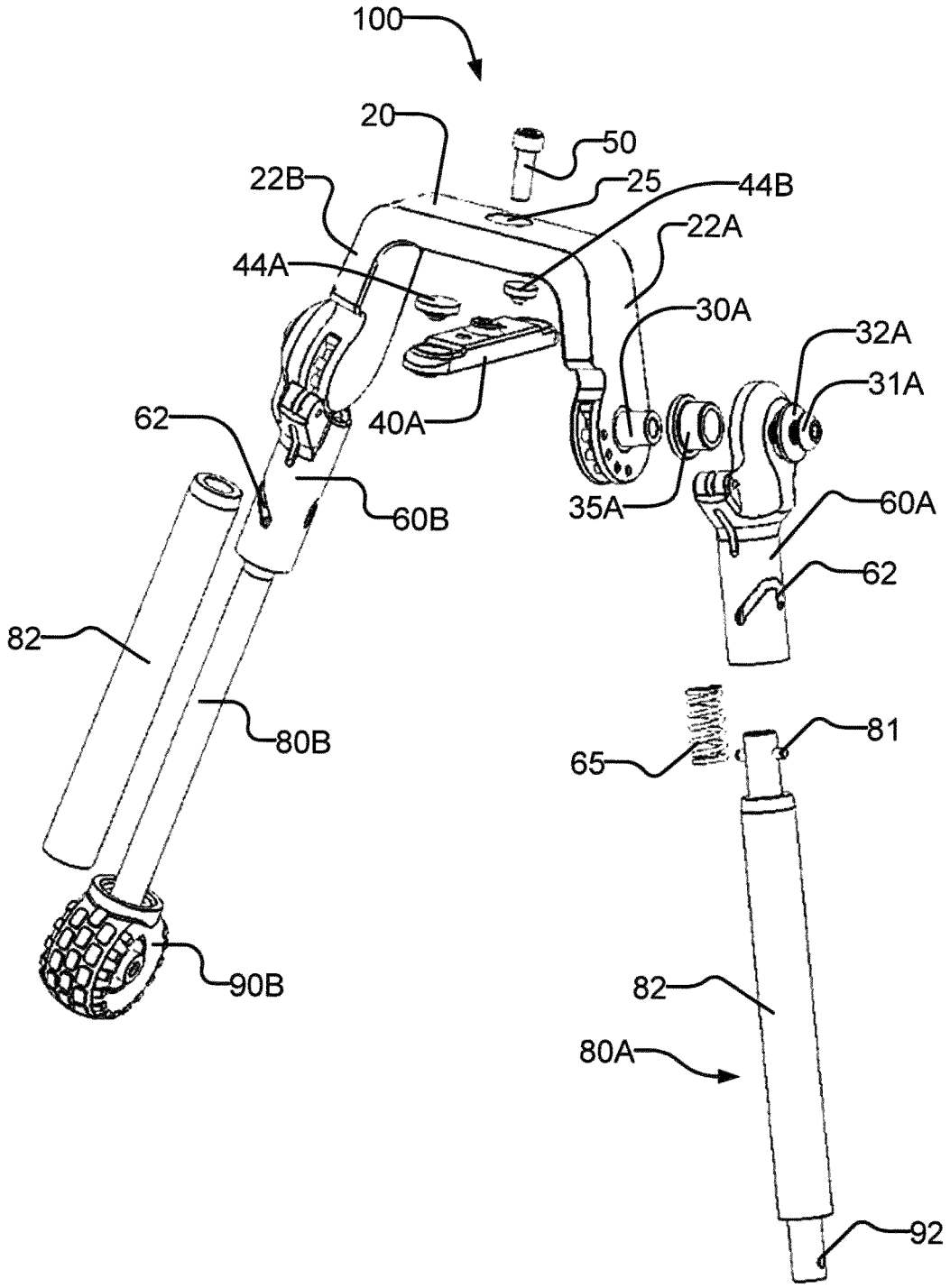
FIG. 2B is an expanded perspective view of an example bipod.

In some embodiments, base 40A may, for example, comprise rounded edges or ends as shown in FIG. 2B.

In the embodiment shown in FIGS. 1 and 2, base 40A attaches to bracket 20 below platform 21. Hence, a projectile weapon will attach to base 40A directly or through an adaptor at a point above the projectile weapon's center of gravity in, for example, a self-levelling configuration. In some embodiments, joint 50 may comprise bearings or the like that allow base 40A (and a mounted weapon) to pan, tilt and roll relative to bracket 20 (i.e. joint 50 allows for three degrees of freedom in such embodiments). In some embodiments, the bearings may be spherical.

Figure 3A:
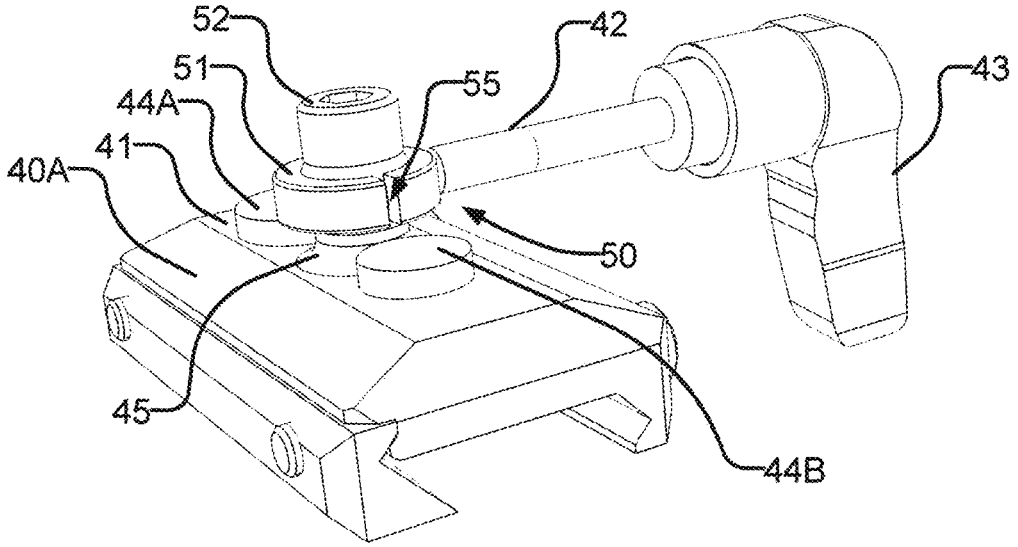
FIG. 3A is a perspective view of the bipod base and bearing assembly attached to the bipod shown in FIG. 1.

FIG. 3A is a perspective view of an example embodiment of base 40A, mounting joint 50, tension screw 42 and handle 43 disengaged from bracket 20. In some embodiments, mounting joint 50 comprises a tightening mechanism. Such tightening mechanism may, for example, be used to restrict movement of base 40A relative to bracket 20 and may comprise means for varying an amount by which movement of base 40A relative to bracket 20 is restricted. For example, the tightening mechanism may comprise race 51 described elsewhere herein in combination with tension screw 42 (i.e. the means for varying the amount by which movement of base 40A relative to bracket 20 is restricted).

Figure 3B:
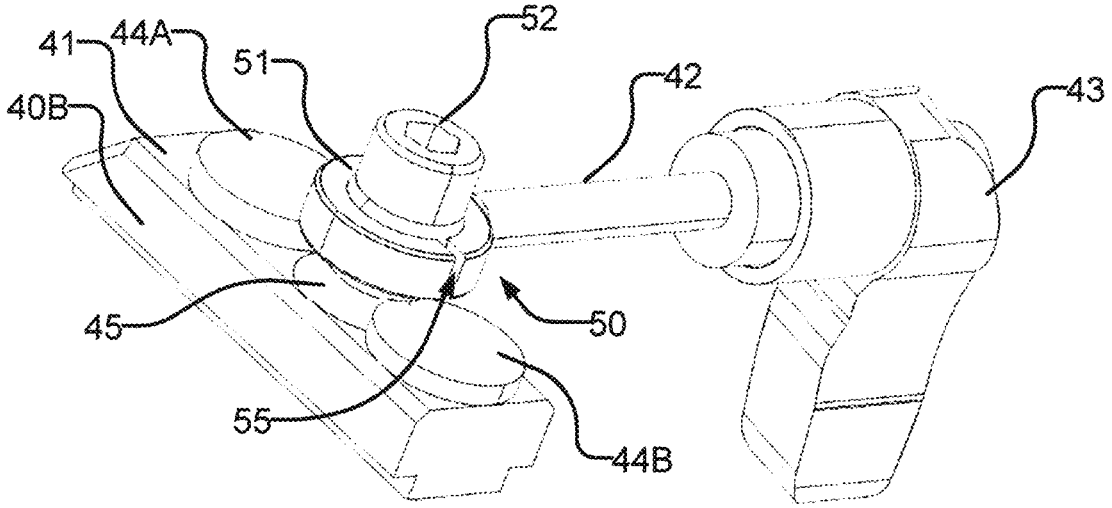
FIG. 3B is a perspective view of another example embodiment of a bipod base and bearing assembly.

FIG. 3B is a perspective view of an example embodiment of base 40B, mounting joint 50, tension screw 42 and handle 43 disengaged from bracket 20. In some embodiments, base 40A and base 40B can be interchanged with each other.

In some embodiments, mounting joint 50 has three degrees of freedom (e.g. pan, tilt and roll relative to bracket 20) allowing base 40A or 40B to pivot relative to bracket 20 about three different axes of rotation passing through mounting joint 50. In such embodiments, mounting joint 50 may comprise a spherical bearing.

Figure 3C:
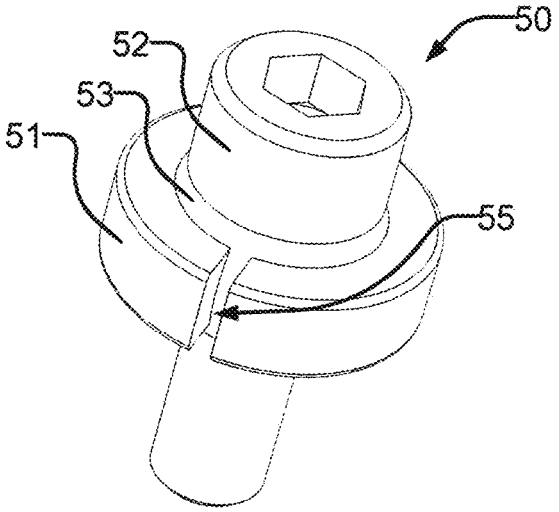
FIG. 3C is a perspective view of an example embodiment of a spherical joint attachable to the bipod bases shown in FIGS. 3A and 3B.
Figure 3D:
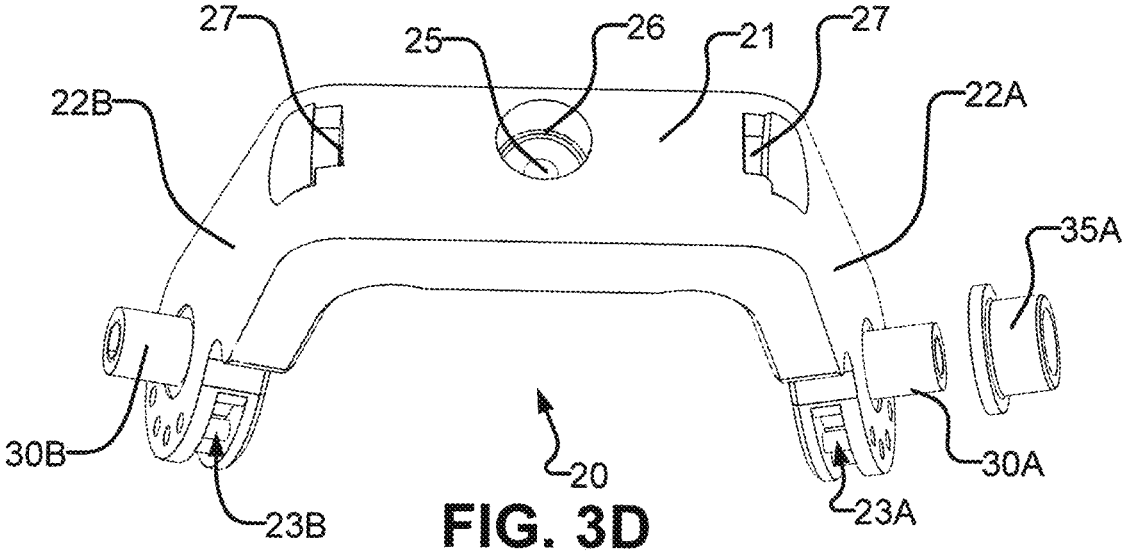
FIG. 3D is a perspective view of a bipod bracket designed to receive a bipod base like those shown in FIGS. 3A and 3B.

FIG. 3C is a perspective view of an example embodiment of mounting joint 50, where mounting joint 50 comprises a race 51, mounting screw 52 and ball 53. In some embodiments, bracket 20 may comprise a hole 25 (as shown in FIG. 3D) passing through the center of platform 21 to receive mounting joint 50. Hole 25 may comprise a shouldered layer 26 (as shown in FIG. 3D) at or near the bottom surface of platform 21 to support race 51 inside hole 25.

Mounting joint 50 may engage bracket 20 by sitting on shouldered layer 26 as described above, or via other means. Ball 53 of mounting joint 50 may be attached to raised boss 45 at the top of base 40A or 40B with mounting screw 52 while leaving a gap between the bottom surface of platform 21 and top surface 41 of base 40A or 40B. This configuration allows base 40A or 40B to remain attached to bracket 20 (through mounting joint 50) while being able to move freely around the center of mounting joint 50 at the same time.

In some embodiments, race 51 may comprise radial gap 55 (as shown in FIG. 3C). Radial gap 55 may be tightened or loosened to adjust the tightness of race 51 around ball 53. Increasing the tightness of race 51 increases the force required to move attached base 40A or 40B relative to bracket 20, whereas decreasing the tightness of race 51 decreases this force.

In some embodiments, bracket 20 may comprise bore 27 for receiving a screw or the like to adjust the tightness of a tightening mechanism corresponding to a mounting joint 50. The bore may extend in a direction generally perpendicular to both a bore axis (e.g. line 101 in FIG. 5) of a mounted weapon and a central axis of hole 25 receiving mounting joint 50.

In the example embodiment shown in FIG. 3A, tension screw 42 with adjustable handle 43 can be threaded through bore 27 of bracket 20 to engage race 51 at about a right angle to radial gap 55 (in such embodiments, bore 27 comprises a thread pattern corresponding to the thread pattern of tension screw 42). By turning handle 43, tension screw 42 presses radially towards or away from race 51 depending on the direction of rotation of handle 43. Radial gap 55 allows race 51 to tighten or loosen around ball 53 to respectively increase or decrease friction between ball 53 and race 51. Hence, pivotal movement of an attached base 40A can be restricted or expanded relative to bracket 20 by turning handle 43. In some embodiments, either end of bracket 20 may receive handle 43 and tension screw 42 thereby supporting ambidextrous adjustment of handle 43 (i.e. both sides of bracket 20 comprise a bore 27 as shown, for example, in FIG. 3D).

Coupling base 40A to bracket 20 using mounting joint 50 results in a corresponding gap extending between a surface of base 40A (e.g. top surface 41 (see FIG. 3A)) and an opposing surface of bracket 20 (e.g. a bottom surface of platform 21). Such gap provides a "locking mechanism" allowing base 40A to rapidly transition from a mobile state (where base 40A may pivot freely (i.e. pan, tilt and/or roll) relative to bracket 20 as described elsewhere herein) and a rigid state (where base 40A cannot pivot freely relative to bracket 20 as described elsewhere herein). In some embodiments, the locking mechanism comprises, for example, a surface of base 40A frictionally engaging an opposing surface of bracket 20. In such embodiments, friction between the surface of base 40A and the opposing surface of bracket 20 precludes pivotal movement of base 40A relative to bracket 20. In some embodiments, base 40A may comprise one or more frictional elements frictionally engageable with the opposing surface of bracket 20 for increasing a coefficient of friction between base 40A and bracket 20. Such frictional elements may be made from any suitable materials including, but not limited to, rubber, polyurethane or the like.

In some embodiments, as shown in FIG. 3A for example, base 40A comprises friction elements 44A, 44B. Friction elements 44A, 44B may, for example, be attached to top surface 41 of base 40A. In some embodiments, friction elements 44A, 44B form a part of top surface 41. Friction elements 44A, 44B may or may not be identical to each other. Friction elements 44A, 44B may be made from different materials, shaped differently, designed with different thicknesses from each other, etc. In some embodiments, friction elements 44A, 44B may have cross-sections that are rectangular, circular, triangular, pentagonal, hexagonal, octagonal or the like.

Figure 4A:
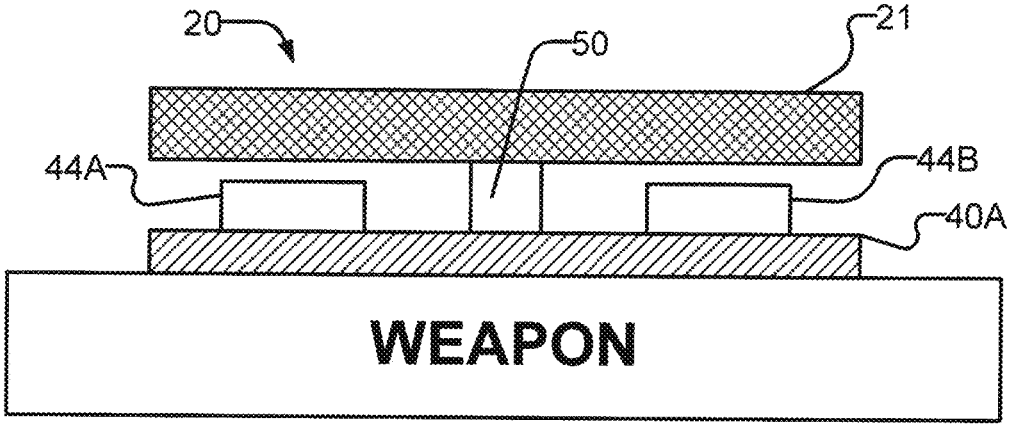
FIGS. 4A to 4C are schematic views of example friction locks between a base and a bracket of a bipod.

The thickness of friction elements 44A, 44B and/or the height of boss 45 can be chosen so as to leave a small gap between the top of friction elements 44A, 44B and platform 21 when bipod 100 is in a "neutral" state (e.g. a state where an attached weapon has not been aligned with an intended target) (see FIG. 4A). When an operator frictionally engages top surface 41 with platform 21, base 40A and bracket 20 are "locked" together transitioning base 40A from a mobile state to a rigid state. Due to, for example, the relatively small size of the gap between friction elements 44A, 44B and platform 21 and the fulcrum provided by the length of a mounted weapon, the weapon only needs to move a short distance to create contact friction strong enough to lock base 40A against bracket 20. Hence, an operator can align a weapon with a target by freely rotating base 40A around mounting joint 50, and once proper alignment has been achieved and the operator is ready to fire, s/he can stabilize the weapon quickly and with minimal movement in a multitude of positions during shot execution by frictionally engaging base 40A with bracket 20. Locking can be achieved in any relative position between base 40A and bracket 20, as chosen by the operator for proper alignment with the target.

Upon firing of a shot, recoil forces may automatically unlock base 40A (e.g. transition base 40A from a rigid state to a mobile state) allowing the weapon to move freely rearward and allowing for more of the recoil force to be directed and dissipated in a direction along the bore axis, which may improve precision and accuracy and may allow for better shot follow-through (e.g. by an operator's body absorbing a portion of the recoil forces, bipod 100 absorbing a portion of the recoil forces, etc.). It will be appreciated that in operation in certain leg deployment positions, such as that exemplified in FIG. 1., base 40A, joint 50, legs 70 and the circular contact surface between feet 90 and the support surface form and act as a parallelogram mechanism which in use allows the bracket to translate backwards as the weapon recoils during a shot, allowing the coupled weapon to move relatively freely and quasi-linearly backwards under recoil. This may advantageously reduce disturbances to alignment, improve precision and accuracy, and prevent the bipod from "jumping" upon recoil which would require re-alignment of the bipod for a subsequent shot.

Figure 11:
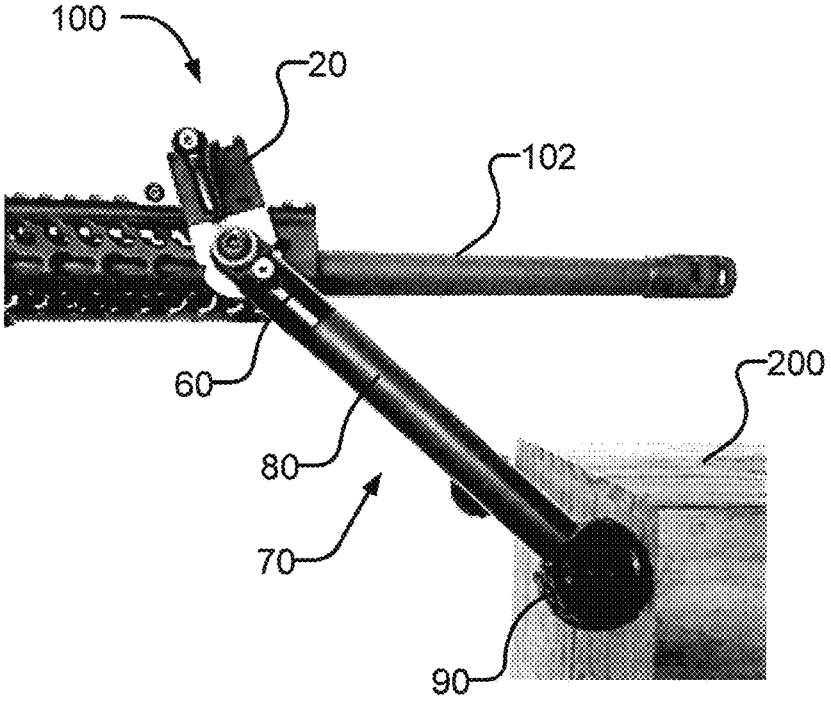
FIG. 11 is a perspective view of an example embodiment of a bipod with its legs deployed in an example forward firing position.

Friction elements 44A, 44B do not need to engage platform 21 at the same time to stabilize a mounted weapon. In some embodiments, only one of friction elements 44A, 44B engages platform 21 at any given time depending on factors including but not limited to the design of friction elements 44 (i.e. friction elements 44A, 44B), the position of legs 80, the angle of shooting, etc. For example, friction element 44A may act as a front bumper useful for locking a mounted weapon in position when legs 70 are deployed in a direction generally perpendicular to the bore axis of the mounted weapon (as shown in FIG. 4B), while friction element 44B may act as a rear bumper (as shown in FIG. 4C) useful for locking a mounted weapon in position when legs 70 are deployed in alternative shooting positions (e.g. a forward position as seen in FIG. 11).

In some embodiments, friction element 44B may aid in arresting and/or dissipating rearward movement of a weapon under recoil.

As described elsewhere herein, FIG. 4A schematically illustrates bipod 100 in a neutral position. In such position, a surface of base 40A is not frictionally engaged with an opposing surface of bracket 20 allowing for pivotal movement of base 40A relative to bracket 20 (i.e. base 40A is in its mobile state). FIGS. 4B and 4C schematically illustrate bipod 100 in example locked positions. In such positions, friction element 44A (FIG. 4B) or friction element 44B (FIG. 4C) frictionally engage the opposing surface of bracket 20 precluding pivotal movement of base 40A relative to bracket 20 (i.e. base 40A is in its rigid state). Base 40A and/or frictional elements 44A, 44B may, for example, be frictionally engaged with an opposing surface of bracket 20 by one or both of a weight of the weapon and a force applied to the weapon by the operator (e.g. a force applied to a stock of the weapon in a direction towards bipod 100, through a technique known to persons skilled in the art as "loading the bipod").

Figure 4B:
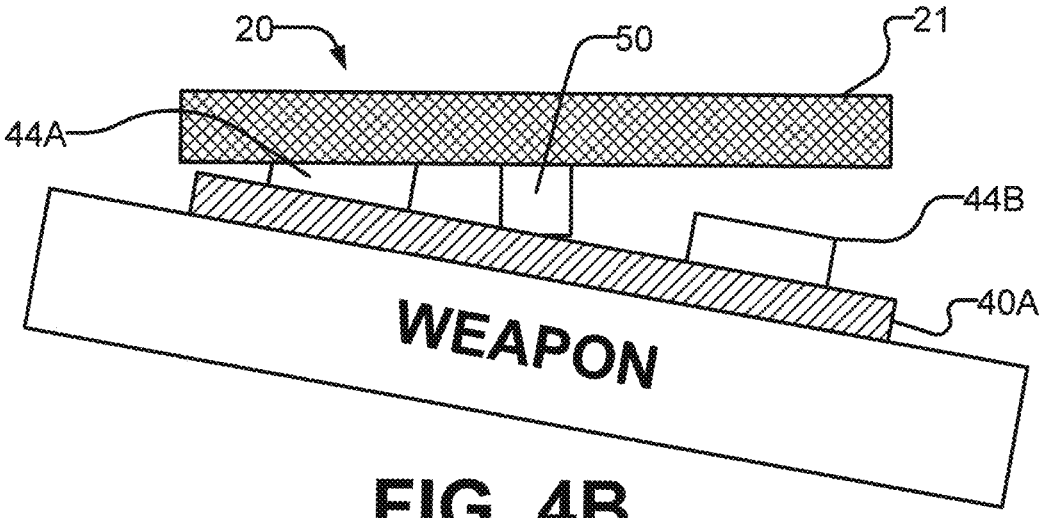
Figure 4C:
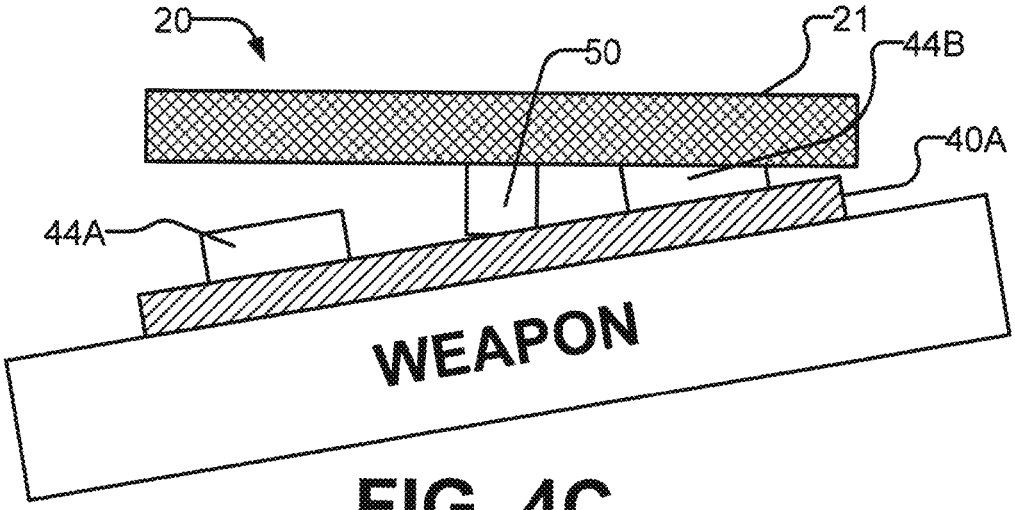

Although the exemplary schematic illustrations of bipod 100 in FIGS. 4A to 4C illustrate a base 40A comprising two friction elements 44A, 44B, a person skilled in the art will readily understand based on the disclosure of the invention herein that base 40A may frictionally engage an opposing surface of bracket 20 in alternate embodiments where base 40A comprises no friction elements (i.e. a surface of base 40A directly frictionally engages an opposing surface of bracket 20), a single friction element or more than two friction elements.

In some embodiments, only base 40A comprises one or more friction elements described herein. In some embodiments, one or more of the friction elements described herein may be attached to, or form a part of, a surface of bracket 20. In such embodiments, both base 40A and bracket 20 may comprise friction elements. In alternate embodiments, only bracket 20 comprises friction elements.

Figure 5:
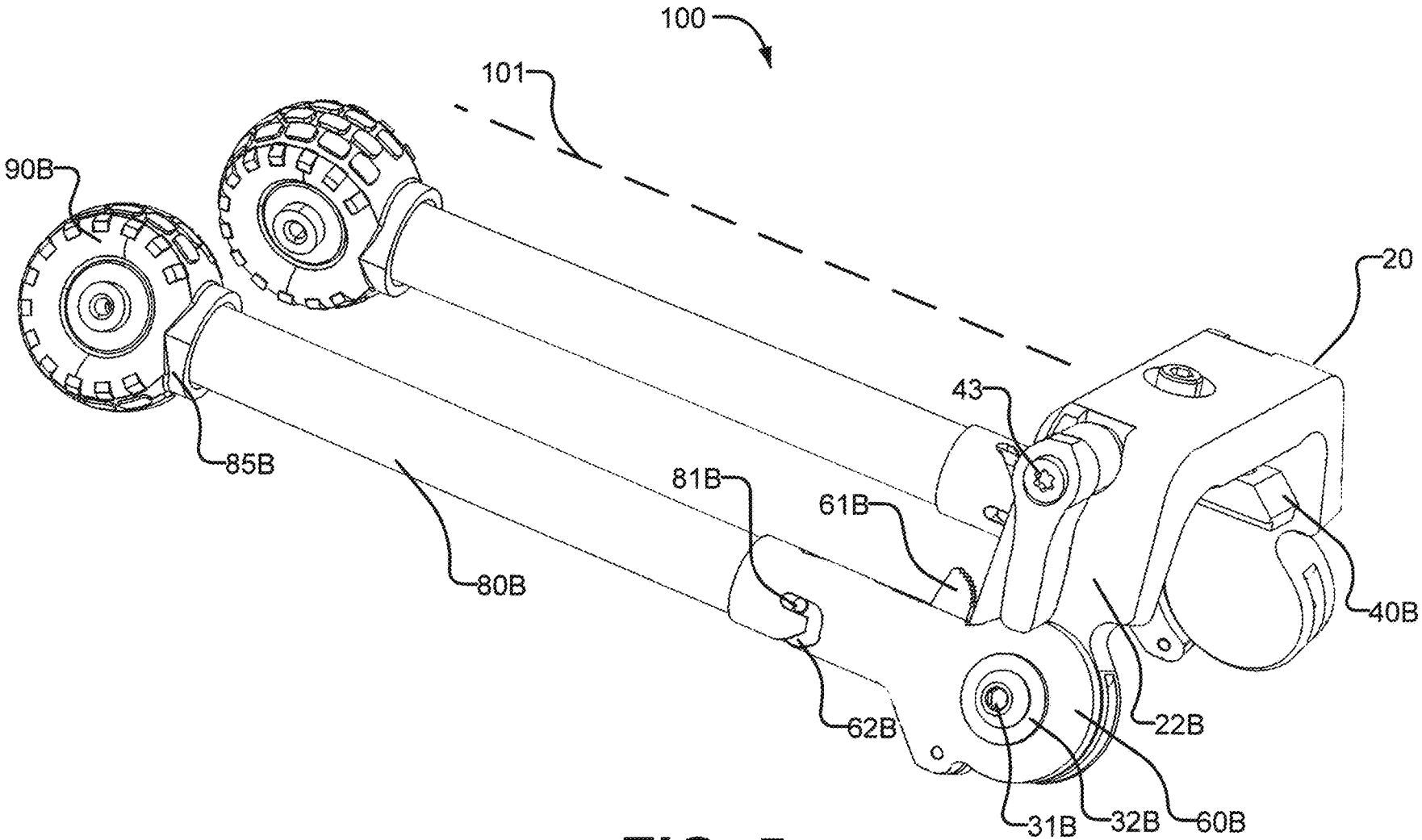
FIG. 5 is a side view of an example bipod in an alternate position with its legs folded in an example rest position.

FIG. 5 is a side view of bipod 100 comprising legs 70 retracted into a rest position (alternatively may be referred to as a "storage" position).

In the example embodiment shown in FIG. 5, leg cylinder 60B is pivotally connected to bracket 20 at arm 22B. Leg cylinder 60B may comprise lever 61B biased by a spring (e.g. spring 65B shown in FIG. 6). In some embodiments, leg 70B can be deployed from a rest position to a firing position (as shown in FIG. 2) by actuating lever 61B. In some embodiments, leg 70B can be deployed from a rest position to a firing position by mechanically rotating leg 70B around the pivoted connection without the need to actuate lever 61B. This allows for quick deployment of leg 70B from its rest position to its firing position. Leg 70A may be coupled to bracket 20 at arm 22A in an identical, similar, or different way.

Figure 6:
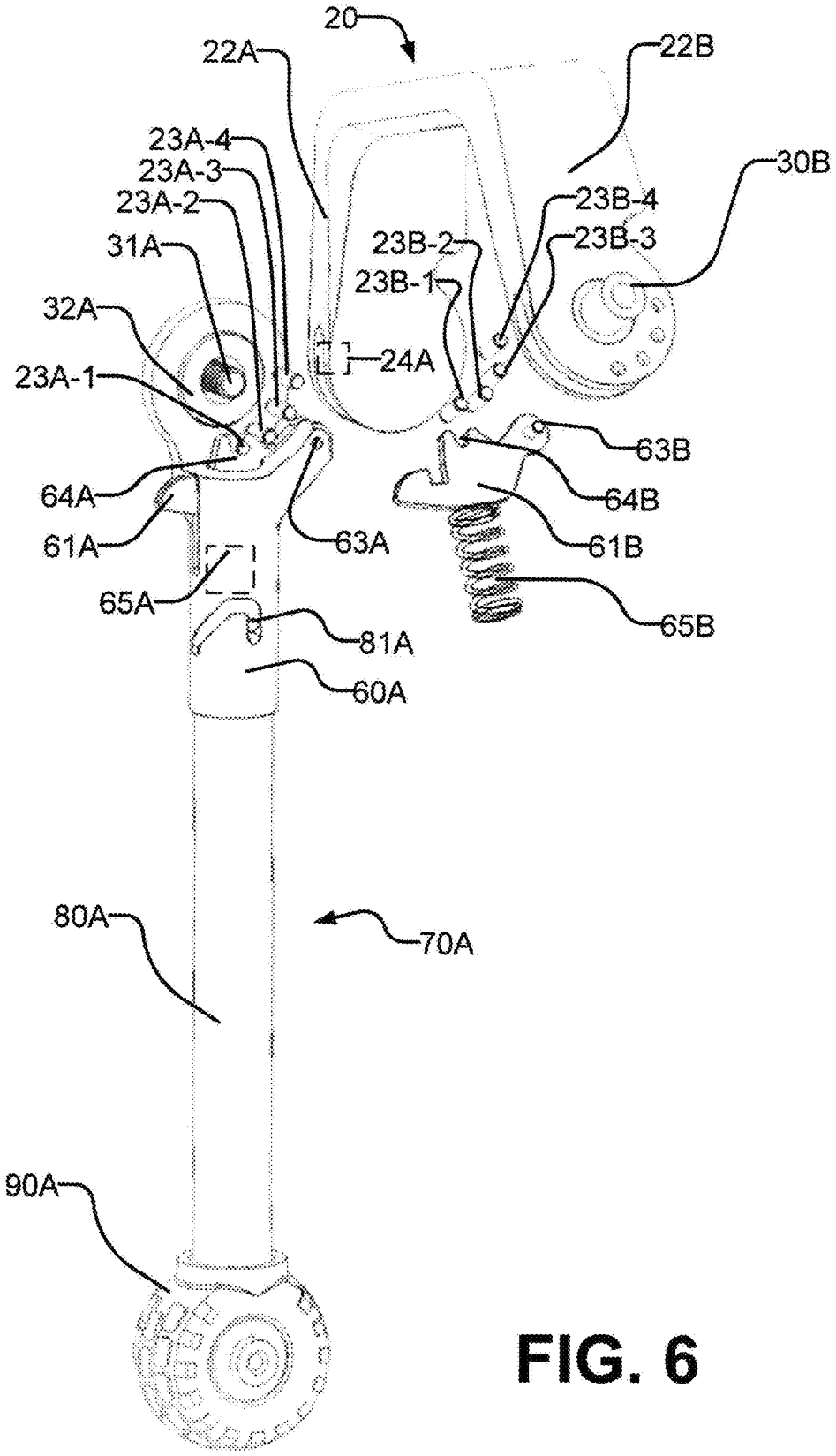
FIG. 6 is an expanded schematic view illustrating a mechanism for deploying and locking the legs of a bipod in various positions according to an example embodiment.

FIG. 6 is an expanded schematic view illustrating an example mechanism for deploying and locking legs 70 of bipod 100 in various firing positions according to an example embodiment. To avoid obscuring the schematic illustration of FIG. 6, only a single leg 70 (i.e. leg 70A) is illustrated. The mechanism described below may be equally applied to leg 70B.

In the example embodiment shown in FIG. 6, arm 22A comprises shaft 30A (counterpart of shaft 30B, see FIG. 3D for shaft 30A). Shaft 30A may mate with a bore in cylinder 60A (not shown in FIG. 6), whereby cylinder 60A is pivotally attached to arm 22A. Shaft 30A may comprise an axial threaded hole, receiving side screw 31A. Side screw 31A and washer 32A secure leg cylinder 60A against arm 22A while allowing leg cylinder 60A to pivot about a central axis passing through shaft 30A.

In some embodiments, bushing 35A (see FIG. 2B, for example) is mounted over shaft 30A and is received within a bore of leg cylinder 60A. Likewise, a bushing may be mounted over shaft 30B. Such bushing and bushing 35A may be collectively referred to as bushings 35. In some embodiments, bushings 35 may be used to reduce rotational friction and/or to isolate the transmission of shocks and/or vibrations between bracket 20 and leg cylinders 60A, 60B respectively. One or both of bushings 35 may, for example, be a cylindrical bushing, a flange bushing or the like.

In some embodiments, arm 22A may comprise indexing pins 23A and an indentation 24A. Pins 23A and indentation 24A may, for example, be distributed around an arcual groove extending circumferentially around the end of arm 22A (as partially shown in FIG. 3D). Leg cylinder 60A engaging bracket 20 through shaft 30A may comprise lever 61A pivotable around anchor pin 63A and biased against spring 65A (e.g. a spring identical to, or a counterpart of, spring 65B). Lever 61A may comprise a flared notch 64A capable of engaging position pins 23A or resting in indentation 24A (e.g. a flared notch identical to, or a counterpart of, flared notch 64B).

When leg member 80A (or leg 70A) is folded in its storage position, flared notch 64A snuggly rests in indentation 24A. In some embodiments, indentation 24A comprises a pin similar to indexing pins 23A such that an operator needs to press lever 61A against spring 65A to disengage flared notch 64A from the pin to deploy leg member 80A (or leg 70A) from its storage position to a firing position. In some embodiments, indentation 24A does not have any such pin. In such embodiments, indentation 26A and flared notch 64A are shaped to allow the side part of flared notch 64A to slide up on a ramp and release from indentation 24A and slide on a raised segment of the circumferential groove at the end of arm 22A when an operator applies force to rotate leg member 80A (or leg 70A) around the axis of shaft 30A to deploy in its firing position. The ramp profile in indentation 24A and corresponding profile of the side of flared notch 64A allows leg cylinder 60A to pivot around shaft 30A without the need for an operator to activate a release mechanism to rotate leg member 80A into a firing position.

In the example embodiment shown in FIG. 6, arm 22A comprises four position pins 23A that correspond to different firing positions. When an operator applies force to pivot leg cylinder 60A (and attached leg member 80A) around shaft 30A, flared notch 64A slides along the circumferential groove at the end of arm 22A until it engages the first pin of indexing pins 23A (as seen in FIG. 6). Flared notch 64A may, for example, be designed to eliminate play and maintain a play-free engagement over a long period of time by compensating for wear. Spring 65A applies pressure on lever 61A to ensure that flared notch 64A firmly engages an indexing pin 23A.

In the example embodiment shown in FIG. 6, the first pin of indexing pins 23A is positioned such that leg member 80A (or leg 70A) extends in a direction generally perpendicular to a mounted weapon's bore axis (e.g. line 101 in FIG. 5) when flared notch 64A engages the first pin (i.e. pin 23A-1 as shown in FIG. 6). Other pins (e.g. pins 23A-2, 23A-3, 23A-4, etc.) may be distributed across the circumferential groove of the end of arm 22A to lock leg member 80A at different angles depending on which pin flared notch 64A engages. In the example embodiment shown in FIG. 6, pins 23A are distributed evenly such that the angle between leg member 80A (or leg 70A) and a mounted weapon's bore axis is 90° when flared notch 64A engages the first pin (i.e. pin 23A-1), 60° when flared notch 64 engages the second pin (i.e. pin 23A-2), 30° when flared notch 64 engages the third pin (i.e. pin 23A-3), and 0° when flared notch 64A engages the last pin (i.e. pin 23A-4) (e.g. leg member 80A is parallel to a mounted weapon's bore axis). In other embodiments, different angles can be achieved by modifying the distribution and/or number of position pins 23A.

Figure 7:
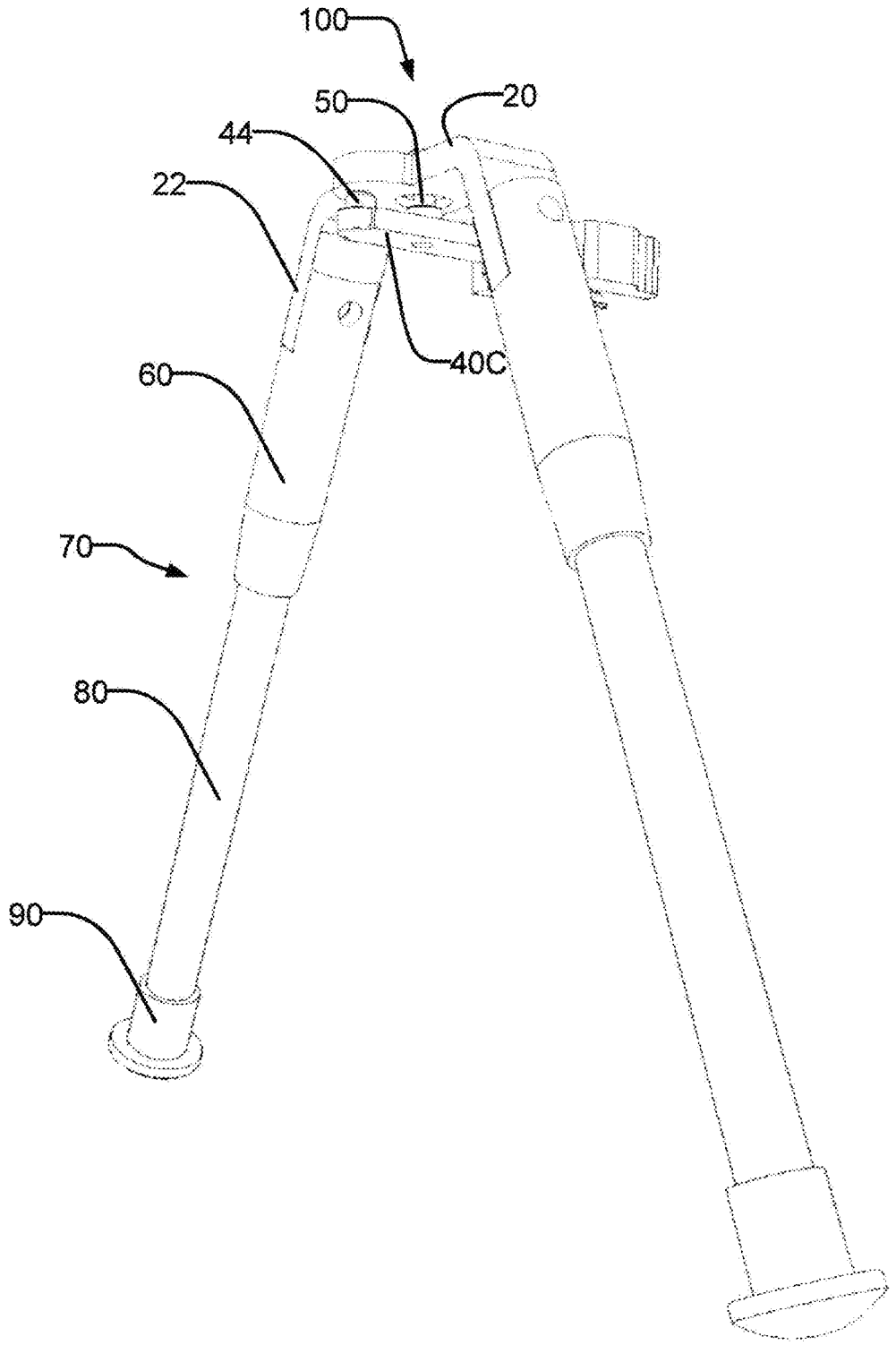
FIGS. 7 to 9 are perspective views of another example embodiment of a bipod.
Figure 8:
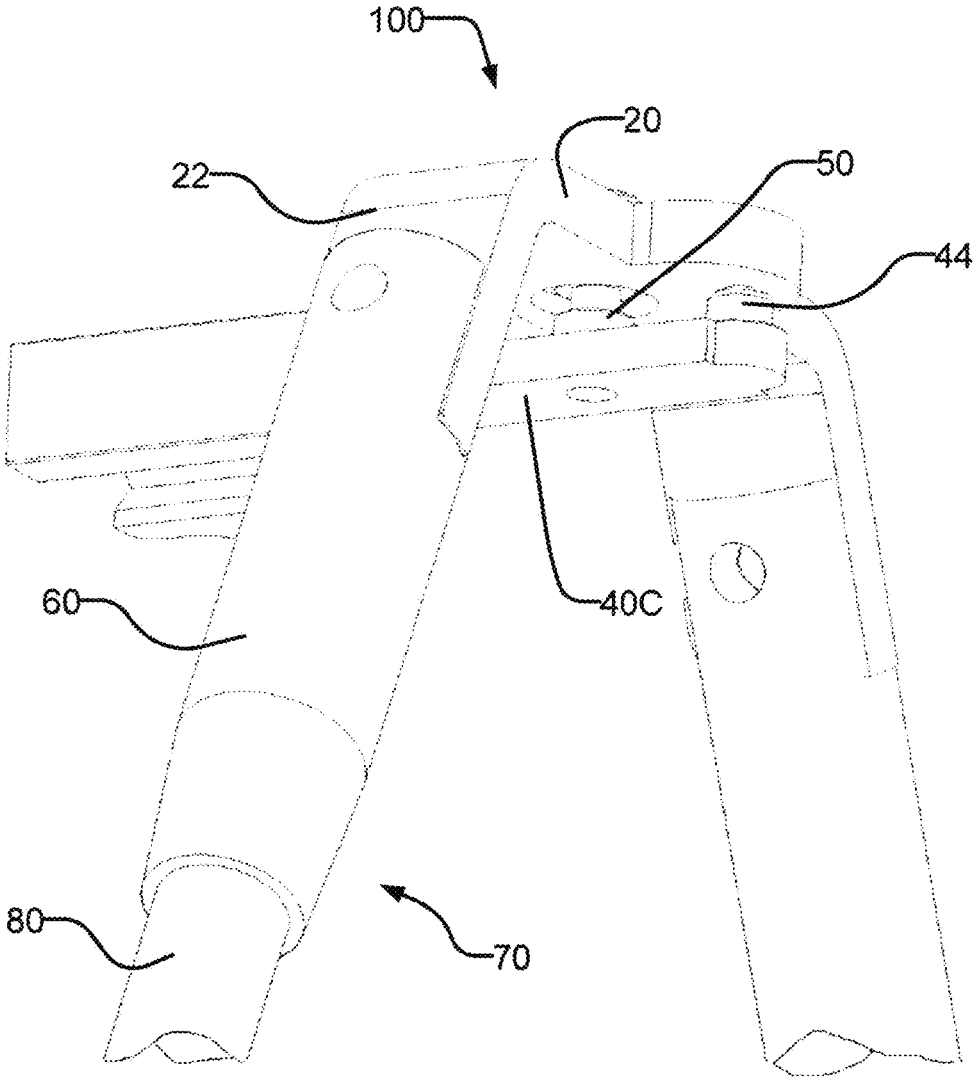
Figure 9:
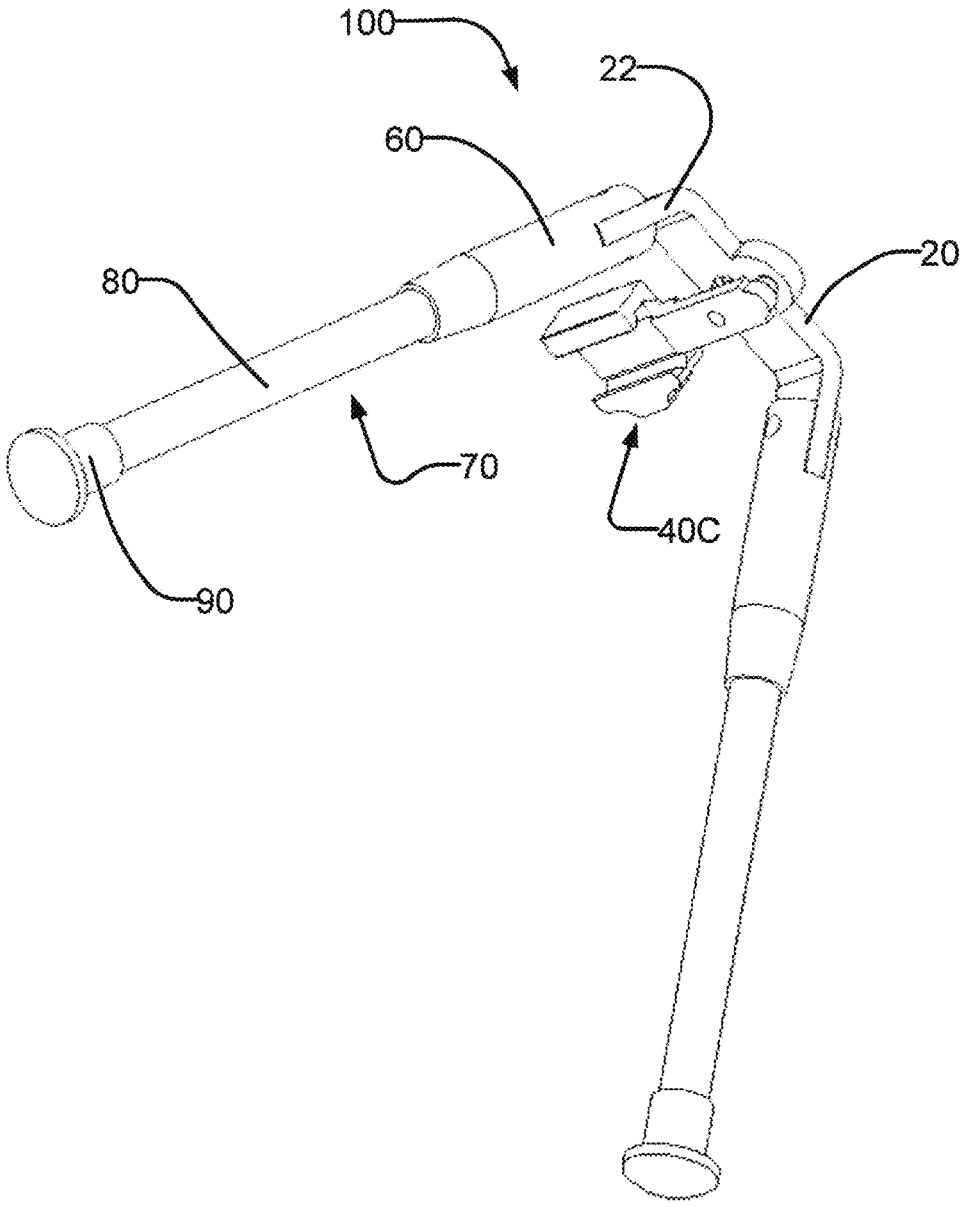

In some embodiments, bipod 100 may be as shown in FIGS. 7 to 9. In such embodiments, bipod 100 comprises a base 40C with a single friction element 44. Loading an attached weapon (i.e. transitioning base 40C from a mobile state to a rigid state) frictionally engages friction element 44 with a bottom surface of bracket 20. Such embodiments, may also comprise, semi spherical shaped feet 90. Leg cylinders 60 couple leg members 80 to bracket arms 22. In some such embodiments, friction between bracket arms 22 and cylinders 60 respectively facilitates positioning legs 70 in a plurality of different firing positions.

Figure 10:
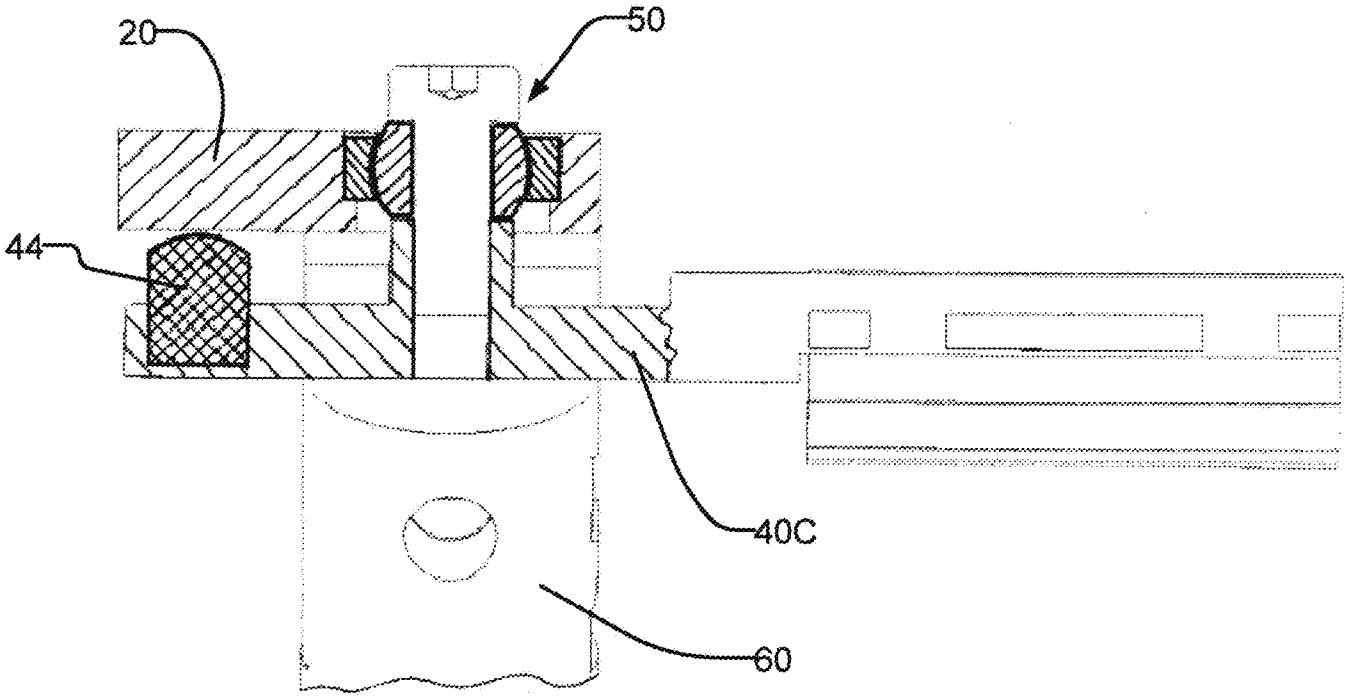
FIG. 10 is a cross-sectional view of a base, joint and bracket of the bipod shown in FIGS. 7 to 9.

FIG. 10 is a cross-sectional view of base 40C and bracket 20 corresponding to bipod 100 shown in FIGS. 7 to 9. Base 40C, as shown in FIG. 10, is in its neutral state (i.e. base 40C is pivotally movable relative to bracket 20).

FIG. 11 is a perspective view of bipod 100 with its legs deployed in an alternative firing position. The toroidal shape of feet 90 allows bipod 100 to stabilize against vertical support surface 200 when legs 70 are propped forward. As previously discussed, friction elements 44A, 44B (hidden from view in FIG. 11) may be designed to allow mounted weapon 102 to lock in position at different angles relative to legs 70.

Figure 12:
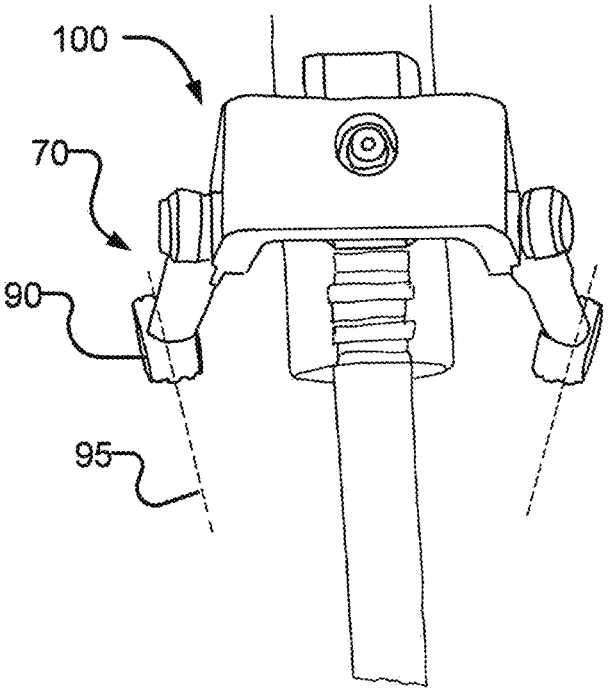
FIG. 12 is a top view illustrating the feet of the bipod angled inwards to improve stability according to an example embodiment.

FIG. 12 is a top view illustrating feet 90 of the bipod 100 angled inwards to improve stability according to an example embodiment. In some embodiments, feet 90 may be adjusted to modify the angle between feet lines 95 and the bore axis of a mounted weapon. These adjustments may be made by twisting feet 90 relative to legs 70, rotating the joint between feet 90 and legs 70, etc. In some embodiments, feet 90 are non-adjustable.

As described elsewhere herein, some embodiments of bipod 100 provide built-in shock and/or vibration isolators and/or shock and/or vibration dampers to reduce disturbances caused by both internally generated shocks and/or vibrations (e.g. movement of the weapon's mechanism, explosive initiation of the propellant charge by the primer, pressure waves created by the burning propellant inside the bore of a weapon, friction between the accelerating projectile and the bore of a weapon, etc.) and external shocks and/or vibrations (e.g. when shooting from a vehicle or aircraft). For example, friction elements 44A, 44B may be made of materials with good shock and/or vibration damping properties (e.g. rubber, polyurethane, etc.) to absorb shocks and/or vibrations transmitted from the weapon and/or reflected back to the weapon through the connection between base 40A and bracket 20. Additionally, the coupling mechanism between leg cylinders 60 and shafts 30 (e.g. shafts 30A, 30B) may comprise a bushing 35 made from shock and/or vibration damping material (e.g. self-lubricating polymer, vibration damping polymer, etc.). Legs 70 may also comprise outer sleeves 82 made of rubber, polyurethane, or other suitable material with good shock and/or vibration damping properties that fully or partially enclose legs 70 (or leg members 80) and dampen shocks and/or vibrations propagating along legs 70 (or leg members 80). In preferred embodiments, feet 90 may also be made of a material with good shock and/or vibration damping properties and may dampen shocks and/or vibrations propagating along legs 70 (or leg members 80) and/or dampen the effects on bipod 100 of shocks and/or vibrations traveling across a supporting surface. In some embodiments, mounting joint 50 and/or springs 65 may also dampen shocks and/or vibrations propagating through bipod 100.

Bipod 100, may, for example, be used to stabilize a projectile weapon. Bipod 100 may be removably coupled to a projectile weapon using any method described elsewhere herein. Once the projectile weapon is coupled, frictionally engaging one or more of friction elements 44A, 44B with bracket 20 may, for example, stabilize the projectile weapon. Friction elements 44A, 44B may be frictionally engaged to bracket 20 using any method described elsewhere herein. Frictions elements 44A, 44B may, for example, be frictionally engaged to a bottom surface of platform 21 as described elsewhere herein.

In the exemplary embodiments described herein, bases 40A, 40B, and 40C are shown as being coupled below bracket 20. A person skilled in the art will recognize that bases 40A, 40B, and 40C may, for example, be coupled above bracket 20 (i.e. a bottom surface of base 40A, 40B, or 40C would be frictionally engageable with a top surface of the bracket). A person skilled in the art will recognize that other types bases are available and may be coupled above or below bracket 20. In some embodiments of the invention, bases 40A, 40B, and 40C may be coupled to bracket 20 in any orientation so long as their surface is frictionally engageable with a surface of bracket 20.

Interpretation of Terms

Unless the context clearly requires otherwise, throughout the description and the claims:

"comprise", "comprising", and the like are to be construed in an inclusive sense, as opposed to an exclusive or exhaustive sense; that is to say, in the sense of "including, but not limited to";

"connected", "coupled", "attached" or any variant thereof, means any connection, coupling or attachment, either direct or indirect, between two or more elements; the coupling, connection or attachment between the elements can be physical, logical or a combination thereof;

"herein", "above", "below", and words of similar import, when used to describe this specification, shall refer to this specification as a whole, and not to any particular portions of this specification;

"or", in reference to a list of two or more items, covers all of the following interpretations of the word: any of the items in the list, all of the items in the list, and any combination of the items in the list;

the singular forms "a", "an", and "the" also include the meaning of any appropriate plural forms.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

What is claimed is:

1. A bipod for supporting an attached projectile weapon, the bipod comprising:

a bracket shaped to receive the projectile weapon, the bracket comprising first and second opposing ends; and a base attachable to the projectile weapon, the base pivotally coupled to the bracket at a joint located between the first and second opposing ends of the bracket, the base frictionally engageable with the bracket to inhibit pivotal movement of the base relative to the bracket, wherein inhibiting pivotal movement of the base relative to the bracket retains the projectile weapon in a desired orientation relative to the bipod;

wherein the base comprises:

a first friction element coupled to a first end of a surface of the base, the first friction element frictionally engageable with an opposing surface of the bracket to provide a first friction lock, the first friction lock retaining the projectile weapon in a first plurality of orientations relative to the bipod; and a second friction element coupled to a second end of the surface of the base, the second end distal from the first end, the second friction element frictionally engageable with the opposing surface of the bracket to provide a second friction lock, the second friction lock retaining the projectile weapon in a second plurality of orientations relative to the bipod, the second plurality of orientations different from the first plurality of orientations; and wherein the first and second friction elements are coupled to the surface of the base on opposing sides of the joint.

2. A bipod according to claim 1 wherein the bipod comprises a first leg pivotally coupled to the first opposing end of the bracket and a second leg pivotally coupled to the second opposing end of the bracket, wherein each of the first and second legs comprises a foot coupled to an end of the leg, the end of the leg distal from the bracket, wherein the foot is made of a material for damping one or both of shock and vibration propagating through one or both of the bipod and the projectile weapon.

3. A bipod according to claim 2 wherein the foot comprises an outer surface continuously engageable with a supporting surface on which the bipod is rested, the continuous engagement comprising the outer surface maintaining engagement with the supporting surface during pivotal movement of one or both of the first and second legs relative to the bracket.

4. A bipod according to claim 3 wherein the foot is toroidal-shaped.

5. A bipod according to claim 2 wherein the first and second legs are each pivotally coupled to the first and second opposing ends of the bracket respectively using a coupling mechanism, the coupling mechanism comprising a bracket pin engageable with a leg notch to lock the first and second legs in a first position relative to the bracket.

6. A bipod according to claim 5 wherein the coupling mechanism further comprises a plurality of additional bracket pins engageable with the leg notch to lock the first and second legs in a plurality of positions different from the first position.

7. A bipod according to claim 2 wherein each of the first and second legs comprise a leg member removably coupled to a leg cylinder using a bayonet mechanism, the leg cylinder pivotally coupled to the bracket.

8. A bipod according to claim 2 wherein at least one of the first and second legs comprises an outer sleeve, the outer sleeve made of a material for damping one or both of shock and vibration propagating through one or both of the bipod and the projectile weapon.

9. A bipod according to claim 2 wherein the foot is pivotally movable inwards towards a bore axis of the projectile weapon.

10. A bipod according to claim 1 wherein the joint comprises an adjustable tightening mechanism, wherein adjusting the adjustable tightening mechanism adjusts a range of pivotal movement of the base relative to the bracket.

11. A bipod for supporting an attached projectile weapon, the bipod comprising:

a bracket shaped to receive the projectile weapon, the bracket comprising first and second opposing ends;

a first leg pivotally coupled to the first opposing end of the bracket;

a second leg pivotally coupled to the second opposing end of the bracket; and a base attachable to the projectile weapon, the base pivotally coupled to the bracket at a joint located between the first and second opposing ends of the bracket, the base frictionally engageable with the bracket to inhibit pivotal movement of the base relative to the bracket, wherein inhibiting pivotal movement of the base relative to the bracket retains the projectile weapon in a desired orientation relative to the bipod;

wherein the first and second legs are each pivotally coupled to the first and second opposing ends of the bracket respectively using a coupling mechanism, the coupling mechanism comprising a bracket pin engageable with a leg notch to lock the first and second legs in a first position relative to the bracket; and wherein the coupling mechanism further comprises a lever biased by a spring, the lever comprising a flared notch for receiving the pin.

12. A bipod according to claim 11 wherein the coupling mechanism further comprises an indentation, the indentation shaped to receive the lever when folding one or both of the first and second legs into a rest position.

13. A bipod according to claim 12 wherein the indentation comprises a concave-shape and the lever comprises a convex portion, the convex portion of the lever receivable by the concave indentation.

14. A bipod according to claim 13 wherein the flared notch is releasable from the indentation when mechanical force is exerted to rotate one or both of the first and second legs from the rest position to the first position, wherein releasing the flared notch from the indentation requires only gross motor skills of an operator of the projectile weapon.

15. A method for discharging an attached projectile weapon, the method comprising:

removably attaching the projectile weapon to a bipod, the bipod comprising:

a bracket shaped to receive the projectile weapon, the bracket comprising first and second opposing ends;

a first leg pivotally coupled to the first opposing end of the bracket;

a second leg pivotally coupled to the second opposing end of the bracket; and a base attachable to the projectile weapon, the base pivotally coupled to the bracket at a joint located between the first and second opposing ends of the bracket, the base frictionally engageable with the bracket to inhibit pivotal movement of the base relative to the bracket, wherein inhibiting pivotal movement of the base relative to the bracket retains the projectile weapon in a desired orientation relative to the bipod;

resting the bipod on a supporting surface;

aligning the projectile weapon with an intended target, the aligning comprising frictionally engaging the base with the bracket using the weight of the projectile weapon, a force applied to the projectile weapon by an operator of the projectile weapon, or both; and discharging the projectile weapon, the discharging causing the projectile weapon to recoil disengaging the base from the bracket.

16. A bipod for supporting an attached projectile weapon, the bipod comprising:

a bracket shaped to receive the projectile weapon, the bracket comprising first and second opposing ends;

a first leg pivotally coupled to the first opposing end of the bracket;

a second leg pivotally coupled to the second opposing end of the bracket; and a base attachable to the projectile weapon, the base pivotally coupled to the bracket at a joint located between the first and second opposing ends of the bracket, a surface of the base pivotable towards an opposing surface of the bracket and frictionally engageable with the opposing surface of the bracket to inhibit pivotal movement of the base relative to the bracket, wherein inhibiting pivotal movement of the base relative to the bracket retains the projectile weapon in a desired orientation relative to the bipod.

17. A bipod according to claim 16 wherein one or both of the base and the bracket comprise at least one friction element, the friction element having a coefficient of friction that is greater than one or both of a coefficient of friction of the surface of the base and a coefficient of friction of the opposing surface of the bracket.

* * * * *